US008822118B2

(12) United States Patent
Yamamoto et al.

(10) Patent No.: US 8,822,118 B2
(45) Date of Patent: Sep. 2, 2014

(54) TONER, DEVELOPMENT AGENT, AND IMAGE FORMING APPARATUS

(71) Applicants: Atsushi Yamamoto, Shizuoka (JP); Shinya Nakayama, Shizuoka (JP); Hideyuki Santo, Kanagawa (JP); Suzuka Amemori, Shizuoka (JP); Shingo Sakashita, Shizuoka (JP); Masahide Yamada, Shizuoka (JP)

(72) Inventors: Atsushi Yamamoto, Shizuoka (JP); Shinya Nakayama, Shizuoka (JP); Hideyuki Santo, Kanagawa (JP); Suzuka Amemori, Shizuoka (JP); Shingo Sakashita, Shizuoka (JP); Masahide Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/783,810

(22) Filed: Mar. 4, 2013

(65) Prior Publication Data

US 2013/0244154 A1 Sep. 19, 2013

(30) Foreign Application Priority Data

Mar. 15, 2012 (JP) ..... 2012-059440
Jan. 15, 2013 (JP) ..... 2013-004852

(51) Int. Cl.
*G03G 9/087* (2006.01)
*G03G 9/097* (2006.01)

(52) U.S. Cl.
USPC ..... 430/108.4; 430/109.4

(58) Field of Classification Search
USPC ..... 430/108.4, 109.4; 399/252
See application file for complete search history.

(56) References Cited

U.S. PATENT DOCUMENTS 6,015,647 A * 1/2000 Ugai et al. ..... 430/108.4
7,379,696 B2 * 5/2008 Sawada et al. ..... 399/328
7,700,253 B2 * 4/2010 Yamanouchi et al. ..... 430/108.4
2012/0282000 A1 * 11/2012 Nakayama et al. ..... 399/130
2013/0244011 A1 * 9/2013 Sabu et al. ..... 428/206

FOREIGN PATENT DOCUMENTS

| | | |
|---|---|---|
| JP | 62-070859 | 4/1987 |
| JP | 62-070860 | 4/1987 |
| JP | 63-038955 | 2/1988 |
| JP | 2001-305796 | 11/2001 |
| JP | 2002-082485 | 3/2002 |
| JP | 2002-108018 | 4/2002 |
| JP | 2002-207316 | 7/2002 |
| JP | 2003-098736 | 4/2003 |
| JP | 2003-167380 | 6/2003 |
| JP | 2004-053847 | 2/2004 |
| JP | 2004-177496 | 6/2004 |
| JP | 2004-191927 | 7/2004 |
| JP | 2004-287149 | 10/2004 |
| JP | 2004-331936 | 11/2004 |
| JP | 2005-092097 | 4/2005 |
| JP | 2005-140987 | 6/2005 |
| JP | 2005-227671 | 8/2005 |
| JP | 2005-227672 | 8/2005 |
| JP | 2005-271507 | 10/2005 |
| JP | 2006-071994 | 3/2006 |
| JP | 2006-072095 | 3/2006 |
| JP | 2006-145725 | 6/2006 |
| JP | 2010-077419 | 4/2010 |
| JP | 2011-048315 | 3/2011 |
| JP | 2011-138120 | 7/2011 |
| JP | 2012-042939 | 3/2012 |

OTHER PUBLICATIONS

Diamond, A.S., et al., ed., Handbook of Imaging Materials, Second Edition, Marcel Dekker, Inc., NY (2002), pp. 146-148.*

* cited by examiner

*Primary Examiner* — Janis L Dote
(74) *Attorney, Agent, or Firm* — Oblon, Spivak, McClelland, Maier & Neustadt, L.L.P.

(57) ABSTRACT

Toner containing a binder resin that contains at least one kind of resin having a crystalline polyester unit as its main component and a releasing agent containing a straight-chain mono ester having 48 or more carbon atoms accounting for 40% by weight or more of the releasing agent.

13 Claims, 2 Drawing Sheets

TONER, DEVELOPMENT AGENT, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2012-059440 and 2013-004852, filed on Mar. 15, 2012 and Jan. 15, 2013, respectively, in the Japan Patent Office, the entire disclosures of which are hereby incorporated by reference herein.

BACKGROUND

1.. Field

The present invention relates to toner, a development agent, and an image forming apparatus.

2.. Background Art

Printers and multi-functional printers (MFP) using image forming apparatuses employing electrophotography have been required to be environmentally friendly in recent years.

Attempts are being made to achieve that goal, such as reducing the amount of carbon dioxide emissions by consuming less power and becoming carbon neutral by using biomass raw materials.

Against this backdrop, using toner that is fixed at lower temperatures is desired.

One known way to achieve such toner is to add a crystalline resin typified by a crystalline polyester resin that melts instantly upon heating during fixing to the binder resin for use in the toner.

In addition, JP-H04-24702-B (JP-S62-070859-A) and JP-H04-24703-B (JP-S62-070860-A) disclose methods of using a crystalline resin as the main component of the binder resin.

In general, toner contains a releasing agent such as wax to impart releasability to the toner to facilitate separation from a fixing member during fixing.

Such a releasing agent is also required for toner having a crystalline polyester resin as its main component.

For example, hydrocarbon-based wax, such as paraffin wax or microcrystalline wax, is widely used as the releasing agent.

However, when such wax is used, material attaches to and accumulates on a recording medium discharging member provided downstream of the fixing member, which can damage the fixed image.

If ester wax having an ester bond unit in its molecule is used, such material accumulation is not significantly noticeable but the releasing ability suffers, which tends to result in winding-round of the recording medium during fixing.

For example, JP-2010-77419-A discloses using crystalline particulates having a particular storage elastic modulus and loss elastic modulus as resin particulates having excellent low-temperature fixability and clumping resistance while also using an aliphatic acid ester such as behenyl behenate as the releasing agent.

However, problems persist in the form of contamination of the discharging member after fixing and poor fixing releasability particularly in the case of thin paper.

SUMMARY

The present invention provides toner containing a binder resin that contains at least one kind of resin having a crystalline polyester unit as its main component and a releasing agent containing a straight-chain mono ester having 48 or more carbon atoms accounting for 40% by weight or more of the releasing agent. The toner may be manufactured by granulation in an aqueous medium.

The at least one kind of resin manufactured by granulation in an aqueous medium may be a modified crystalline resin having an isocyanate group at an end thereof and prepared by elongation reaction and/or cross-linking reaction with an active hydrogen group while granulating toner particles by dispersion and/or emulsification in an aqueous medium.

As another aspect of the present invention, a development agent is provided which is comprised of the toner mentioned above and toner carrier.

As another aspect of the present invention, an image forming apparatus is provided which includes an image bearing member to bear a latent electrostatic image thereon, a charger to charge the image bearing member, an irradiator to irradiate a charged image bearing member to form the latent electrostatic image thereon, a development device to develop the latent electrostatic image with the toner or the development agent mentioned above to obtain a toner image, a transfer device to transfer the toner image formed on the image bearing member onto a recording medium, and a fixing device to fix the toner image transferred onto the recording medium.

BRIEF DESCRIPTION OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein.

DETAILED DESCRIPTION OF THE INVENTION

Figure 1:
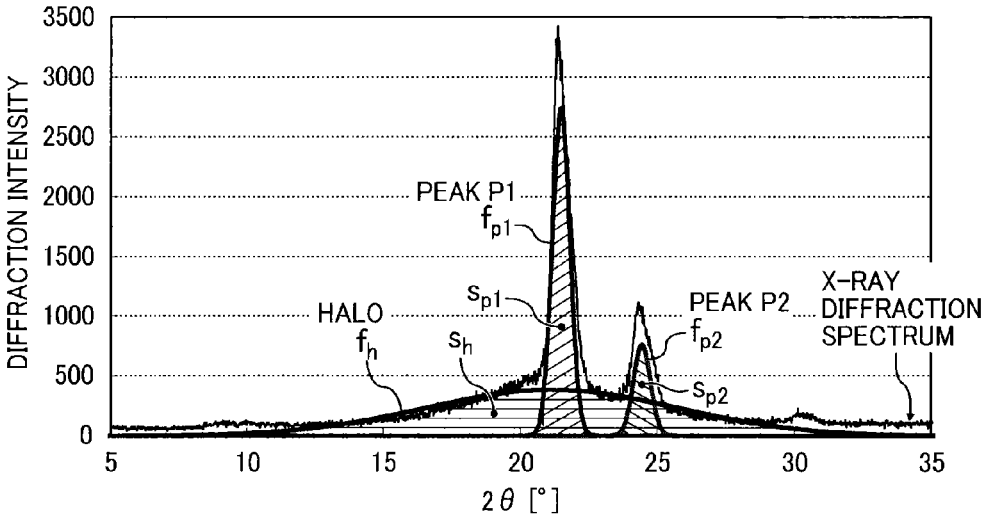
FIG. 1 is a diagram illustrating an example of the diffraction spectrum obtained by X-ray diffraction measuring and fp1(2θ), fp2(2θ), and fh(2θ) after fitting.

An image forming apparatus is provided which includes a latent image bearing member, a charging device to charge the surface of the latent image bearing member, an irradiator to irradiate the surface of the charged latent image bearing member to form a latent electrostatic image, a development device to develop the latent electrostatic image with the toner mentioned above to obtain a visual toner image, a transfer device to transfer the visual toner image to a recording medium, and a fixing device to fix the image transferred to the recording medium thereon.

The mechanism of the present disclosure is inferred as follows:

The resin having a crystalline polyester unit contained as the main component of the binder resin in the present disclosure contains more alkylene portions than typically-used non-crystalline polyester resin.

If the ratio of straight-chain mono esters having 47 or less carbon atoms in the releasing agent is high, the affinity between the releasing agent and the resin having a crystalline polyester unit increases, resulting in a mixing state of part of the resin and the releasing agent.

Consequently, the power of the releasing agent decreases in comparison with a typical releasing agent containing a non-crystalline polyester resin as its main component. When fixing an image on thin paper in particular, the stiffness of paper is weak, which leads to insufficient releasability.

This causes winding-round of paper to a fixing member.

That is, in the case of the resin having a crystalline polyester unit with more alkylene portions contained as the main component of the binder resin, a releasing agent such as wax having an ester bond with an alkyl chain does not demonstrate sufficient releasing power unless it contains a large number of carbon atoms with a low polarity.

If the content ratio of the straight-chain mono esters having 47 or less carbon atoms in the releasing agent is 40% by weight or more, winding-round of paper to a fixing member is prevented even when fixing an image on thin paper.

In addition, a compound having two or more ester portions has insufficient releasability even when the number of carbon atoms is 48 or greater because there are many polarity portions therein.

Therefore, mono esters are suitable in the present disclosure.

In addition, contamination by attachment of the releasing agent to a discharging member is seen in the case of using paraffin wax or microcrystalline wax, which has low polarity.

An inferred mechanism of this contamination is that a minute amount of such wax evaporates during fixing, is cooled down at the discharging member, and adheres thereto.

One way to reduce the volatility is to increase the molecular weight of the releasing agent.

However, when a hydrocarbon-based wax such as polyethylene wax or polypropylene wax is used, the adherence thereof to the discharging member is reduced but the releasing power is not exhibited in the case in which the resin having a crystalline polyester unit is used as the main component because such wax has such a high melting point that it is not melted during fixing.

To the contrary, an ester wax having an ester bond in the molecule does not easily evaporate because of the aggregation energy of the ester bond portion, which leads to prevention of the contamination to the discharging member.

Releasing Agent

In the present disclosure, a releasing agent that contains a straight-chain mono ester having 48 or more carbon atoms accounting for 40% by weight or more of the releasing agent is used.

When the carbon chain is branched, the compatibility with the binder resin increases, which decreases the releasing power.

Therefore, it is suitable to use a straight-chain mono ester.

The content of the straight-chain mono ester is preferably 50% by weight or more, more preferably 50% by weight or more, and furthermore preferably 95% by weight or more.

The more the content, the better the releasing power and the less the contamination due to the adherence of the releasing agent to the discharging port.

Specific examples of the straight-chain mono ester include, but are not limited to, synthesized ester compounds and natural ester wax.

The synthesized compound is obtained by esterification reaction of a straight-chain higher alcohol, and a straight-chain higher carboxylic acid or a straight chain higher carboxylic acid halogenated compound.

Specific examples of the straight-chain higher alcohol include, but are not limited to, stearyl alcohol, behenyl alcohol, tetracosanol, hexacosanol, octacosanol, and triacontanol.

Specific examples of the straight-chain higher carboxylic acid include, but are not limited to, stearic acid, arachic acid, behenic acid, lignoceric acid, cerinic acid, montanic acid, and melissic acid.

One way to manufacture such a synthesized ester compound is: conduct esterification reaction (condensation reaction) by using the straight-chain higher carboxylic acid to the straight-chain higher alcohol and remove excessive straight-chain higher carboxylic acid by deoxidation using an alkali aqueous solution.

In this reaction, using a catalyst is optional.

Since the esterification reaction is equilibrium reaction accompanied by dehydration, it is suitable to conduct the reaction while distilling away produced water in the system.

It is also suitable to conduct reaction at high temperatures at which water produced in the water is distilled away and below which the reactive raw materials escape.

Natural wax is obtained by separating and refining wax taken from animals and plants.

Specific examples thereof include, but are not limited to, candelilla wax, carnauba wax, rice wax, Japan wax, jojoba wax, bees wax, lanolin wax, montane wax, and sunflower wax.

However, since the natural ester wax is a mixture of many kinds of compounds, it requires separation and refinement before using it as the releasing agent of the present disclosure.

Among these, sunflower wax is preferable because it contains a large amount of straight-chain mono ester having a large number of carbon atoms.

The releasing agent preferably has a melting point of from 65° C. to 80° C. and more preferably from 70° C. to 80° C.

When the melting point of the toner is too low, the high temperature stability tends to deteriorate.

When the melting point of the toner is too high, the toner is not easily melted during fixing, so that the releasing power is not sufficiently demonstrated.

In addition, the endothermic peak half value width is preferably 10° C. or less and more preferably 8° C. or lower.

When the half value is too high, it means that the toner contains a large amount of a component that melts at lower temperatures or higher temperature.

The component that melts at lower temperatures tends to have an adverse impact on the high temperature stability.

The component that melts at higher temperatures has a possibility of not contributing to the releasing property.

The content of the releasing agent in the toner is preferably from 3% by weight to 20% by weight and more preferably from 4% by weight to 14% by weight based on the toner.

When the content is too small, the releasing power during fixing tends to deteriorate.

When the content is too large, the high temperature stability tends to worsen and the discharging member is easily contaminated by the attachment of the releasing agent.

Binder Resin

The binder resin for use in the present disclosure contains the resin having a crystalline polyester unit as the main component. Two or more such resins having different molecular weights may be used as the main component. The crystalline polyester unit may be a blocked polymer of a polyester and a polyurethane.

Specifically, the resin having a crystalline polyester unit is accounts for 50% by weight or more of the entire binder resin, preferably 60% by weight or more, more preferably 75% by weight or more, and furthermore preferably 90% by weight or more.

The more the resin having a crystalline polyester unit, the more excellent the low temperature fixability of the toner.

Specific examples thereof include, but are not limited to, resins formed of only crystalline polyester units (also simply referred to as crystalline polyester resin), resins in which crystalline polyester units are linked, resins in which crystalline polyester units and other polymers are linked, which are so-called block polymers or graft polymers.

The resin formed of only crystalline polyester units has a high crystallinity but it is preferable to use resins in which crystalline polyester units having a large aggregation energy such as an ester bond portion, a urethane bond portion, urea bond portion, and a phenylene bond portion, and so-called block polymers or graft polymers crystalline polyester units and other polymers are linked in terms of imparting the resin with strength.

Crystalline Polyester Unit

Specific examples of the crystalline polyester unit include, but are not limited to, polycondensed polyester units synthesized by polyol and carboxylic acid, lactone ring opening polymers, and polyhydroxycarboxylic acid. Among these, the polycondensed polyester units synthesized by polyol and carboxylic acid are preferable in terms of demonstration of the crystallinity.

Polyol

Specific examples of the polyol include, but are not limited to, diols, and tri- or higher polyols.

There is no specific limit to the diol.

Specific examples thereof include, but are not limited to, aliphatic diols such as straight chain type aliphatic diols and branch-chain aliphatic diol; alkylene ether glycol having 4 to 36 carbon atoms; alicyclic diols having 4 to 36 carbon atoms; alkylene oxides (AO) of the alicyclic diols; adduct of bisphenols with AO; polylactone diols, polybutadiene diol; diols having carboxylic groups; diols having sulfonic acid group or a sulfamic acid group; and diols having other functional groups such as salts of the specified above.

Among these diols, it is preferable to use aliphatic diols having 2 to 36 carbon atoms in the chain and more preferable to use straight-chain aliphatic diols.

These can be used alone or in combination.

The content of the straight chain type aliphatic diol is preferably 80 mol % or more and more preferably 90 mol % or more of the entire diol.

When the content is within this range, the crystallinity of the resin ameliorates and the low temperature fixability and the high temperature stability strike a good balance, which is preferable in terms of the tendency of improvement of the hardness of the resin.

There is no specific limit to the straight chain type aliphatic diol.

Specific examples thereof include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol. Among these, considering the availability, ethylene glycol, 1,3-propane diol, 1,4-butane diol, 1,6-hexane diol, 1,9-nonane diol, and 1,10-decane diol are preferable.

There is no specific limit to the branch-chain aliphatic diols having 2 to 36 carbon atoms in the chain include, but are not limited to, 1,2-propylene glycol, butane diol, hexane diol, octane diol, decane diol, dodecane diol, tetradecane diol, neopentyl glycol, and 2-diethyl-1,3-propane diol.

There is no specific limit to the alkylene ether glycol having 4 to 36 carbon atoms.

Specific examples thereof include, but are not limited to, diethylene glycol, triethylene glycol, dipropylene glycol, polyethylene glycol, polypropylene glycol, and polytetramethylene ether glycol.

There is no specific limit to the alicyclic diols having 4 to 36 carbon atoms.

Specific examples thereof include, but are not limited to, 1,4-cyclohexane dimethanol and hydrogenated bisphenol A.

There is no specific limit to the alkylene oxides (AO) of the alicyclic diols.

Specific examples thereof include, but are not limited to, adducts (added number of mols: 1 to 30) with such as ethylene oxide (EO), propylene oxide (PO), butylene oxide (BO).

There is no specific limit to the bisphenols.

Specific examples thereof include, but are not limited to, adducts of bisphenol a, bisphenol f, and bisphenol s with 2 to 30 mols of AO (EO, PO, and BO).

There is no specific limit to the polylactone diols.

A specific example thereof is poly-ϵ-caprolactone diol.

There is no specific limit to the diols having carboxylic groups.

Specific examples thereof include, but are not limited to, dialkylol alkanoic acid having 6 to 24 carbon atoms such as 2,2-dimethylol propionic acid (DMPA), 2,2-dimethylol butanoic acid, 2,2-dimethylol heptanoic acid, and 2,2-dimethylol octanoic acid.

There is no specific limit to the diols having sulfonic acid group or sulfamic acid group.

Specific examples thereof include, but are not limited to, N,N-bis (2-hydroxyalkyl) sulfonic acid diol and adducts thereof with AO, where the alkyl group has one to six carbon atoms, AO includes EO, PO, or mixtures thereof, and the mol number of AO is from one to six and N,N-bis (2-hydroxyalkyl) sulfonic acid diol and adducts thereof with AO, where the alkyl group has one to six carbon atoms, AO includes EO, PO, or mixtures thereof, and the mol number of AO is from one to six.

There is no specific limit to the neutralizing bases when using diols having neutralizing bases.

Specific examples thereof include, but are not limited to, tertiary amines (triethyl amine) having 3 to 30 carbon atoms and alkali metals (sodium salts, etc.).

Among these, it is preferable to use an alkylene glycol having 2 to 12 carbon atoms, a diol having a carboxyl group, an adduct of a bisphenol with AO, and a combination thereof.

There is no specific limit to the tri- or higher alcohol components.

Specific examples thereof include, but are not limited to, tri- or higher aliphatic polyols having 3 to 36 carbon atoms (e.g., alkane polyols and inner or inter molecular dehydrated compounds thereof, e.g., glycerine, trimethylol ethane, trimethylol propane, pentaerythritol, sorbitol, sorbitan, and polyglycerine); Sugars and derivatives thereof (e.g., sucrose and methyl glucoside); adducts of trisphenols (e.g., triphenol PA) with 2 mols to 30 of AO; adducts of novolac resins (e.g., phenolic novolac and cresol novolac) with 2 mols to 30 mols of AO; and copolymers of acrylic polyol (e.g., copolymers of hydroxyethyl (meth)acrylate and another vinyl-based monomer).

Among these, tri- or higher aliphatic polyols and adducts of novolac resins with AO are preferable and adducts of novolac resins with AO are more preferable.

Polycarboxylic Acid

Specific examples of the polycarboxylic acid include, but are not limited to, dicarboxylic acids and tri- or higher polycarboxylic acids.

There is no specific limit to the dicarboxylic acid.

Specific examples thereof include, but are not limited to, aliphatic dicarboxylic acids such as straight chain type aliphatic dicarboxylic acids and the branch-chained type aliphatic dicarboxylic acids and aromatic dicarboxylic acids. Among these, using the straight chain type aliphatic dicarboxylic acids is more preferable.

There is no specific limit to the aliphatic dicarboxylic acids.

Specific examples thereof include, but are not limited to, alkane dicarboxylic acids having 4 to 36 carbon atoms such as succinic acid, adipic acid, sebacic acid, azelaic acid, dodecane dicarboxylic acid, octadecane dicarboxylic acid, and decyl succinic acid; alkenyl succinic acids such as dodecenyl succinic acid, pentadecenyl succinic acid, and octadecenyl succinic, alkene dicarboxylic acids having 4 to 36 carbon atoms such as maleic acid, fumaric acid, and citraconic acid, and alicyclic dicarboxylic acids having 6 to 40 carbon atoms such as dimer acid (dimerized linolic acid).

There is no specific limit to the aromatic dicarboxylic acids.

Specific examples thereof include, but are not limited to, aromatic dicarboxylic acids having 8 to 36 carbon atoms such as phthalic acid, isophthalic acid, terephthalic acid, t-butyl isophthalic acid, 2,6-naphthalene dicarboxylic acid, and 4,4'-biphenyl dicarboxylic acid.

Specific examples of the polycarboxylic acids having three or more hydroxyl groups optionally used include, but are not limited to, aromatic polycarboxylic acids having 9 to 20 carbon atoms (e.g., trimellitic acid and pyromellitic acid).

As the dicarboxylic acid or polycarboxylic acids having three or more hydroxyl groups, anhydrides of the compounds specified above or lower alkyl esters (e.g., methyl esters, ethyl esters, or isopropyl esters) having one to four carbon atoms can be used.

Among these dicarboxylic acids, it is particularly preferable to use the aliphatic dicarboxylic acids (preferably adipic acid, sebacic acid, dodecane dicarboxylic acid, terephthalic acid, and isophthalic acid) singly.

Copolymers of the aliphatic dicarboxylic acids and the aromatic dicarboxylic acids (preferably isophthalic acid, terephthalic acid, t-butyl isophthalic acid, and lower alkyl esters of the aromatic dicarboxylic acids) are also preferable. The amount of copolymerized aromatic dicarboxylic acid is preferably 20% by mol or less.

Lactone Ring-Opening Polymer

There is no specific limit to the lactone ring-opening polymers.

Specific examples thereof include, but are not limited to, lactone ring-opening polymers obtained by ring-opening polymerizing a lactone such as a monolactone (the number of ester groups is one in the ring) having 3 to 12 carbon atoms such as β-propio lactone, γ-butylo lactone, δ-valero lactone, and ϵ-capro lactone using a catalyst such as a metal oxide and an organic metal compound and lactone ring-opening polymers having hydroxyl groups at their ends obtained by ring-opening polymerizing the monolactone having 3 to 12 carbon atoms mentioned above by usint a glycol (e.g., ethylene glycol and diethylene glycol) as an initiator.

There is no specific limitation to the monolactone having 3 to 12 carbon atoms.

ϵ-caprolactone is preferable in terms of the crystallinity.

Products of lactone ring-opening polymers available from the market can be also used. These are, for example, high-crystalline polycapro lactones such as PLACCEL series H1P, H4, H5, and H7 (manufactured by DAICEL CORPORATION).

Polyhydroxycarboxylic Acid

There is no specific limit to the preparation method of the polyhydroxy carboxylic acids.

Such polyhydroxy carboxylic acids as the polyester resins are obtained by, for example, a method of direct dehydrocondensation of hydroxycarboxylic acid such as a glycolic acid, lactic acid (L-, D- and racemic form); and a method of ring-opening a cyclic ester (the number of ester groups in the ring is two or three) having 4 to 12 carbon atoms corresponding to an inter two or three molecule dehydrocondensed compound of a hydroxycarboxylic acid such as glycolide and lactide (L-, D- and racemic form) with a catalyst such as a metal oxide and an organic metal compound.

In light of the control of the molecular weight, the ring-opening method is preferable.

Among these, preferable cyclic esters are L-lactide and D-lactide in light of crystallinity.

In addition, these polyhydrocarboxylic acids that are modified to have a hydroxyl group or a carboxyl group at the end are also suitable.

Resins in which Crystalline Polyester Units are Linked

One way to obtain a resin in which the crystalline polyester units are linked is a method of preliminarily preparing a crystalline polyester unit having an active hydrogen such as a hydroxylic group at its end followed by linking with polyisocyanate.

By this method, a urethane bond portion can be introduced into the resin skeleton, thereby increasing the strength of the resin.

Polyisocyanates to react the diols are, for example, diisocyanates or tri- or higher isocyanates.

There is no specific limit to the diisocyanates.

Specific examples thereof include, but are not limited to, aromatic diisocyanates, aliphatic diisocyanates, alicyclic diisocyanates, and aromatic aliphatic diisocyanates. Among these, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, modified diisocyanates thereof (modified compounds having a urethane group, a carbodiimide group, an allophanate group, a urea group, a biuret group, a uretdione group, a uretimine group, an isocyanulate group, and an oxazoline group) are preferable, in which the number of carbon atoms excludes the number of carbon atoms in NCO group.

Also, mixtures thereof are preferable.

Optionally, tri- or higher isocynates can be used in combination therewith.

There is no specific limit to the aromatic diisocyanates.

Specific examples thereof include, but are not limited to, 1,3- and/or 1,4-phenylene diisocyanate, 2,4- and/or 2,6-tolylene diisocyanate (TDI), crude TDI, 2,4'- and/or 4,4'-diphenyl methane diisocyanate (MDI), crude MDI, 1,5-naphtylene diisocyanate, 4,4'4"-triphenyl methane triisocyanate, and m- or p-isocyanato phenyl sulfonyl isocyanate.

There is no specific limit to the aliphatic isocyanates.

Specific examples thereof include, but are not limited to, include, but are not limited to, etyhlene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl)fumarate, bis(2-isocyanato ethyl)carbonate, and 2-isocyanatoethyl-2,6-diisocyanato hexanoate.

There is no specific limit to the alicyclic diisocyanates.

Specific examples thereof include, but are not limited to, isophorone diisocyanate (IPDI), dicyclo hexyl methane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate. There is no specific limit to the aromatic aliphatic diisocyanates.

Specific examples thereof include, but are not limited to, m- and/or p-xylylene diisocyanate (XDI), α, α, α', α'-tetramethyl xylylene diisocyanate (TMXDI).

There is no specific limit to the modified compounds of the diisocyanates.

Specific examples thereof include, but are not limited to, modified compounds having a urethane group, a cabodiimide group, an allophanate group, a urea group, a biuret group, a uretdione group, a uretimine group, an isocyanulate group, and an oxazolidone group. Specifically, these are: modified MDI such as urethane modified MDI, carbodiimide modified MDI, and trihydrocarbyl phosphate modified MDI), modified compounds of diisocyanates such as urethane modified TDI such as a prepolymer containing an isocyanate group, and mixtures thereof such as modified MDI and urethane modified TDI.

Among these, aromatic diisocyanates having 6 to 15 carbon atoms, aliphatic diisocyanates having 4 to 12 carbon atoms, alicyclic diisocyanates having 4 to 15 carbon atoms are preferable, in which the number of carbon atoms excludes the number of carbon atoms in NCO group.

Among these, TDI, MDI, HDI, hydrogenated MDI, and IPDI are particularly preferable.

Resins in which Crystalline Polyester Units are Linked with Other Polymer

Specific ways to obtain a resin in which crystalline polyester units are linked with other Polymers are, for example, a method of preliminarily the crystalline polyester unit and other polymer unit separately and thereafter linking them; a method of preliminarily preparing one of the crystalline polyester unit and other polymer unit and thereafter polymerizing the rest of the units under the presence of the prepared unit; and a method of polymerizing the crystalline polyester unit and other polymer unit simultaneously or sequentially in the same reaction system.

Among these, the first or second method is preferable in terms of easiness of designing.

A specific example of the first method is, as in the method of obtaining the resin in which the crystalline polyester units are linked, that a crystalline polyester unit having an active hydrogen such as a hydroxylic group at its end is preliminarily prepared followed by linking with polyisocyanate.

The polyisocyantes specified above are usable and can be prepared by introducing an isocyanate group at its end of one unit to react the active hydrogen of the other unit.

By this method, a urethane bond portion can be introduced into the resin skeleton, thereby increasing the strength of the resin.

By the second method, the resin in which the crystalline polyester unit and other polymer are linked is prepared by, for example, reacting the hydroxyl group or the carboxylic acid at the end of the crystalline polyester unit with a monomer to obtain the other polymer unit in a case in which the crystalline polyester unit is prepared first and the next polymer unit to be prepared next is a non-crystalline polyester unit, a polyurethane unit, a polyurea unit, etc.

If the polymer unit to be prepared next is a vinyl-based polymer unit, it is possible to obtain a resin in which the crystalline polyester unit and other polymer are linked by preliminarily introducing a double bond of vinyl polymerization property into the crystalline polyester unit followed by polymerizing the vinyl monomer in the presence of the crystalline polyester unit.

Non-Crystalline Polyester Unit

Specific examples of the non-crystalline polyester unit include, but are not limited to, polycondensed polyester units synthesized by polyol and polycarboxylic acid.

It is possible to use the crystalline polyester unit specified above with regard to the polyol and the polycarboxylic acid.

To make a design free from crystallinity, introducing a large number of bending or branch portions into the polymer skeleton is suitable.

Specific examples of the polyol include, but are not limited to, adducts of bisphenol A, bisphenol F, bisphenol S, etc. with AO (EO, PO, BO, etc.) (having an added number of mols ranging from 2 to 30) and derivatives thereof.

Specific examples of the polycarboxylic acid include, but are not limited to, phthalic acid, isophthalic acid, and t-butyl isophthalic acid.

Using tri- or higher polyol or polycarboxylic acid is suitable to introduce the branch portion.

Polyurethane Unit

The polyurethane units are synthesized by polyols such as diols or tri- or higher alcohols and polyisocyanates such as diisocyanates or tri- or higher isocyanates.

Among these, it is preferable to use a polyurethane unit synthesized by the diol specified above and the diisocyanate specified above The polyols such as the diols and tri- or higher polyols specified above described above for the polyester resin can be used.

The same diisocyanates or tri- or higher isocyanates specified above can be used.

Polyurea Unit

The polyurea unit is synthesized by polyamines such as diamines or tri- or higher amines and polyisocyanates such as diisocyanates or tri- or higher isocyanates.

Among these, it is preferable to use a polyurethane unit synthesized by the diol specified above and the diisocyanate specified above The same diisocyanates or tri- or higher isocyanates specified above can be used.

Polyamine

Specific examples of the polyamines include, but are not limited to, diamines and tri- or higher amines.

There is no specific limit to the diamine.

Specific examples thereof include, but are not limited to, aliphatic diamines and aromatic diamines.

Among these compounds, aliphatic diamines having from 2 to 18 carbon atoms and aromatic diamines having from 6 to 20 carbon atoms are preferable.

Optionally, tri- or higher amines can be used.

There is no specific limit to the aliphatic diamines having 2 to 18 carbon atoms.

Specific examples thereof include, but are not limited to, alkylene diamines such as ethylene diamine, propylene diamine, trimethylene diamine, tetramethylene diamine, and hexamethylene diamine; polyalkylene diamines having 2 to 6 carbon atoms such as diethylene triamine, iminobis propyl amine, bis(hexamethylene)triamine, triethylene tetramine, tetraethylne pentamine, and pentaethylene hexamine; substituted compounds thereof with an alkyl having 4 to 18 carbon atoms or a hydroxyl alkyl having 2 to 4 carbon atoms such as dialkyl aminopropyl amine, trimethyl hexamethylene diamine, aminoethyl ethanol amine, 2,5-dimethyl-2,5-hexamethylene diamine, and methyl iminobispropyl amine; alicyclic or heterocyclic aliphatic diamines such as alicyclic diamine having 2 to 4 carbon atoms such as 1,3-diamino cyclehexane, isophorone diamine, menthene diamine, 4,4'-methylene dicyclohexane diamine (hydrogenated methylene dianiline and heterocyclic diamine having 4 to 15 carbon atoms such as piperazine, N-aminoethyl piperazine, 1,4-diaminoethyl piperazine, 1,4,-bis(2-amino-2-methylpropyl) piperazine, 3,9-bis (1,3-aminopropyl)-2,4,8,10-tetraoxaspiro [5,5] undecane; and aromatic aliphatic amines having 8 to 15 carbon atoms such as xylylene diamine, tetrachlor-p-xylylene diamine.

There is no specific limit to the aromatic diamines having 6 to 20 carbon atoms.

Specific examples thereof include, but are not limited to, non-substituted aromatic diamines such as 1,2-, 1,3, or 1,4-phenylene diamine, 2,4', or 4,4'-diphenyl methane diamine, crude diphenyl methane diamine (polyphenyl polymethylene polyamine), diaminodiphenyl sulfone, bendidine, thiodianiline, bis(3,4-diaminophenyl)sulfone, 2,6-diaminopilidine, m-aminobenzyl amine, triphenyl methane-4,4',4"-triamine, and naphtylene diamine; aromatic diamines having a nuclear substitution alkyl group having one to four carbon atoms such as 2,4- or 2,6-tolylene diamine, crude tolylene diamine, diethyle tolylene diamine, 4,4'-diamino-3,3'-dimethyldiphenyl methane, 4,4'-bis(o-toluidine), dianisidine, diamino ditolyl sulfone, 1,3-dimethyl-2,4-diaminobenzene, 1,3-dimethyl-2,6-diaminobenzene, 1,4-diisopropyl-2,5-diamino benzene, 2,4-diamino mesitylene, 1-methyl-3,5-diethyl-2,4-diamino benzene, 2,3-dimethyl-1,4-diamino naphthalene, 2,6-dimethyl-1,5-diamino naphthalene, 3,3',5,5'-tetramethyl bendizine, 3,3',5,5'-tetramethyl-4,4'-diamino diphenyl methane, 3,5-diethyl-3'-methyl-2',4-diamino diphenyl methane, 3,3' diethyl-2,2'-diaminodiphenyl methane, 4,4'-diamino-3,3'-dimethyl diphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminophenyl sulfone; mixtures of isomers of the non-substituted aromatic diamines specified above and the aromatic diamines having a nuclear substitution alkyl group having one to four carbon atoms specified above with various ratios; aromatic diamines having a nuclear substitution electron withdrawing group (such as halogen (e.g., Cl, Br, I, and F, alkoxy groups such as methoxy group and ethoxy group, and nitro group) such as methylene bis-o-chloroaniline, 1-chlor-o-phenylene diamine, 2-chlor-1,4-phenylene diamine, 3-amino-4-chloroaniline, 3-bromo-1,3-phenylene diamine, 2,5-dichlor-1,4-phenylene diamine, 5-nitro-1,3-phenylene diamine, 3-dimethoxy-4-aminoaniline; 4,4'-diamino-3,3'-dimethyl-5, 5'-dibromo-diphenyl methane, 3,3'-dichlorobenzidine, 3,3' dimethoxy benzidine, bis(1-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sufide, bis(4-aminophenyl)telluride, bis (4-aminophenyl)selenide, bis(4-amino-3-methoxyphenyl) disulfide, 4,4'-methylene bis(1-iodoaniline), 4,4'-methylene bis (3-bromoaniline), 4,4'-methylene bis(2-fluoroaniline), 4-aminophenyl-2-chloroaniline), and; aromatic diamines having a secondary amino group (the non-substituted aromatic diamines specified above, the aromatic diamines having a nuclear substitution alkyl group having one to four carbon atoms, mixtures of isomers thereof with various mixing ratio, compounds in which part or entire of the primary amine group of the aromatic diamines having a nuclear substitution electron withdrawing group specified above is substituted with a lower alkyl group such as methyl group and ethyl group to be a secondary amino group) such as 4-4'-di (methylamino) diphenyl methane and 1-methyl-2-methyl amino-4-aminobenzene.

In addition to those, specific examples of the diamines include, but are not limited to, polyamide polyamines (such as low-molecular weight polyamide polyamines obtained by condensation of dicarboxylix acid (e.g., dimeric acid) and excessive (2 mols or more per mol of acid) polyamines (e.g., the alkylene diamines and polyalkylene polyamines) and hydrogenetaed compounds of cyanoethylated polyether polyols (e.g., polyalkeylene glycol).

Vinyl-Based Polymer Unit

The vinyl-based copolymer resins are mono- or co-polymerized polymers unit of vinyl-based monomers. Specific examples of the vinyl-based monomers include, but are not limited to, the following (1) to (10).

1) Vinyl Based Hydrocarbon

Aliphatic vinyl based hydrocarbons: alkenes such as ethylene, propylene, butane, isobutylene, pentene, heptene, diisobutylene, octane, dodecene, octadecene, α-olefins other than the above mentioned; alkadiens such as butadiene, isoplene, 1,4-pentadiene, 1,6-hexadiene, and 1,7-octadiene.

Alicyclic vinyl-based hydrocarbons: mono- or di-cycloalkenes and alkadiens such as cyclohexene, (di)cyclopentadiene, vinylcyclohexene, and ethylidene bicycloheptene; and terpenes such as pinene, limonene and indene.

Aromatic vinyl-based hydrocarbons: styrene and its hydrocarbyl (alkyl, cycloalkyl, aralkyl and/or alkenyl)substitutes, such as α-methylstyrene, vinyl toluene, 2,4-dimethylstyrene, ethylstyrene, isopropyl styrene, butyl styrene, phenyl styrene, cyclohexyl styrene, benzyl styrene, crotyl benzene, divinyl benzene, divinyl toluene, divinyl xylene, and trivinyl benzene; and vinyl naphthalene.

(2) Vinyl-Based Monomer Containing Carboxyl Group and its Salts

Unsaturated mono carboxylic acid and unsaturated dicarboxylic acid having 3 to 30 carbon atoms, and their anhydrides and their monoalkyl (having 1 to 24 carbon atoms) esters, such as vinyl based monomers having carboxylic group such as (meth)acrylic acid, (anhydride of) maleic acid, mono alkyl esters of maleic acid, fumaric acid, mono alkyl esters of fumaric acid, crotonic acid, itoconic acid, mono alkyl esters of itaconic acid, glycol monoether of itaconic acid, citraconic acid, mono alkyl esters of citraconic acid and cinnamic acid.

(3) Vinyl-Based Monomer Having Sulfonic Group, Monoesterified Vinyl Based Sulfuric Acid and their Salts Alkene sulfuric acid having 2 to 14 carbon atoms such as vinyl sulfuric acid, (meth)aryl sulfuric acid, methylvinylsufuric acid and styrene sulfuric acid; their alkyl derivatives having 2 to 24 carbon atoms such as α-methylstyrene sulfuric acid; sulfo(hydroxyl)alkyl-(meth)acrylate or (meth)acryl amide such as sulfopropyl(meth)acrylate, 2-hydroxy-3-(meth)acryloxy propylsulfuric acid, 2-(meth)acryloylamino-2,2-dimethylethane sulfuric acid, 2-(meth)acryloyloxyethane sulfuric acid, 3-(meth)acryloyloxy-2-hydroxypropane sulfuric acid, 2-(meth)acrylamide-2-methylpropane sulfuric acid, 3-(meth)acrylamide-2-hydroxy propane sulfuric acid, alkyl (having 3 to 18 carbon atoms) aryl sulfosuccinic acid, sulfuric esters of poly(n=2 to 30) oxyalkylene (ethylene, propylene, butylenes: (mono, random, block) mono(meth)acrylate such as sulfuric acid ester of poly (n=5 to 15) oxypropylene monomethacrylate, and sulfuric acid ester of polyoxyethylene polycyclic phenyl ether.

(4) Vinyl-Based Monomer Having Phosphoric Group and its Salts

Phosphoric acid monoester of (meth)acryloyl oxyalkyl such as 2-hydroxyethyl(meth)acryloyl phosphate, phenyl-2-acyloyloxyethylphosphate, (meth)acryloyloxyalkyl (having 1 to 24 carbon atoms) phosphonic acids such as 2-acryloyloxy ethylphosphonic acid and their salts, etc.

Specific examples of the salts of the compounds of (2) to (4) include, but are not limited to, alkali metal salts (sodium salts, potassium salts, etc.), alkali earth metal salts (calcium salts, magnesium salts, etc.), ammonium salts, amine salts, quaternary ammonium salts, etc.

(5) Vinyl-Based Monomer Having Hydroxyl Group

Hydroxystyrene, N-methylol(meth)acryl amide, hydroxyethyl(meth)acrylate, (meth)arylalcohol, crotyl alcohol, isocrotyl alcohol, 1-butene-3-ol, 2-butene-1-ol, 2-butene-1,4-diol, propargyl alcohol, 2-hydroxyethylpropenyl ether, simple sugar aryl ether, etc.

(6) Vinyl-Based Monomer Having Nitrogen

Vinyl based monomer having an amino group: aminoethyl (meth)acrylate, dimethylaminoethyl(meth)acrylate, diethylaminoethyl(meth)acrylate, t-butylaminoethyl(meth)acrylate, N-aminoethyl(meth)acrylamide, (metha)arylamine, morpholino ethyl(meth)acrylate, 4-vinylpyridine, 2-vinylpyridine, crotyl amine, N,N-dimethylaminostyrene, methyl-α-acetoaminoacrylate, vinylimidazole, N-vinylpyrrole, N-vinylthiopyrolidone, N-arylphenylene diamine, aminocarbozole, aminothiazole, aminoindole, aminopyrrole, aminoimidazole, and aminomercaptothiazole and their salts.

Vinyl-Based Monomer Having Amide Group: (meth)acrylamide, N-methyl(meth)acrylamide, N-butylacrylamide, diacetone acrylamide, N-methylol(meth)acrylamide, N,N-methylene-bis(meth)acrylamide, cinnamic amide, N,N-dimethylacrylamide, N,N-dibenzylacrylamide, methacrylformamide, N-methyl-N-vinylacetoamide, and N-vinylpyrolidone.

Vinyl-Based Monomer Having Nitrile Group: (meth)acrylonitrile, cyanostyrene and cyanoacrylate.

Vinyl-Based Monomer Having Quaternary Ammonium Group: quaternarized vinyl based monomer having tertiary amine group such as dimethylaminoethyl(meth)acrylate, diethylaminoethyl(meth)acrylate, dimethylaminoethyl (meth)acrylamide, diethylaminoethyl(meth)acrylamide, diarylamine, etc. (quaternaized by using a quaternarizing agent such as methylchloride, dimethyl sulfuric acid, benzyl chloride, dimethylcarbonate).

Vinyl-Based Monomer Having Nitro Group: nitrostyrene, etc.

(7) Vinyl-Based Monomer Having Epoxy Group

Glycidyl(meth)acrylate, tetrahydrofurfuryl(meth)acrylate, and p-vinylphenyl phenyloxide.

(8) Vinyl Esters, Vinyl(Thio)Ether, Vinylketone, Vinyl Sulfonic Acid Vinyl Esters: Vinyl acetate, vinyl butylate, vinyl propionate, vinyl butyrate, diarylphthalate, diaryladipate, isopropenyl acetate, vinylmethacrylate, methyl-4-vinylbenzoate, cyclohexylmethacrylate, benzylmethacrylate, phenyl (meth)acrylate, vinylmethoxyacetate, vinylbenzoate, ethyl-α-ethoxyacrylate, alkyl (having 1 to 50 carbon atoms) (meth) acrylate such as methyl(meth)acrylate, ethyl(meth)acrylate, propyl(meth)acrylate, butyl(meth)acrylate, 2-ethylhexyl (meth)acrylate, dodecyl(meth)acrylate, hexadecyl(meth) acrylate, heptadecyl(meth)acrylate, and eicocyl(meth)acrylate), dialkyl malate (in which two alkyl groups are straight chained, branch chained, or cyclic chained groups and have 2 to 8 carbon atoms), poly(meth)aryloxyalkanes such as diaryloxyethane, triaryloxyethane, tetraaryloxyethane, tetraaryloxypropane, tetraaryloxybutane and tetrametharyloxyethane, vinyl based monomers having polyalkylene glycol chain such as polyethylene glycol (molecular weight: 300) mono(meth)acrylate, polypropylene glycol (molecular weight: 500) monoacrylate, adducts of (meth)acrylate with 10 mol of methylalcoholethyleneoxide, and adducts of (meth)acrylate with 30 mol of lauryl alcohol ethylene oxide), poly(meth)acrylates such as poly(meth)acrylates of polyhydroxyl alcohols (e.g., ethylene glycol di(meth)acrylate, propylene glycol di(meth)acrylate, neopentylglycol di(meth) acrylate, trimethylol propane tri(meth)acrylate, and polyethylene glycol di(meth)acrylate).

Vinyl(thio)ethers: vinylmethyl ether, vinylethyl ether, vinylpropyl ether, vinylbutyl ether, vinyl-2-ethylhexyl ether, vinylphenyl ether, vinyl-2-methoxyethyl ether, methoxy butadiene, vinyl-2-buthxyethyl ether, 3,4-dihydro-1,2-pyrane, 2-buthoxy-2'-vinyloxy diethyl ether, vinyl-2-ethylmercapto ethylether, acetoxystyrene and phenoxy styrene.

Vinyl ketones: vinyl methylketone, vinylethylketone, and vinyl phenylketone.

Vinyl sulfone: divinyl sulfide, p-vinyl diphenyl sulfide, vinyl ethylsulfide, vinyl ethylsulfone, divinyl sulfone, and divinyl sulfoxide.

(9) Other Vinyl-Based Monomer

Isocyanate ethyl(meth)acrylat, and m-isopropenyl-α,α-dimethylbenzyl isocyanate.

(10) Vinyl-Based Monomer Having Fluorine Atom 4-fluorostyrene, 2,3,5,6-tetrafluorostyrene, pentafluorophenyl(meth)acrylate, pentafluorobenzyl(meth)acrylate, perfluorocyclohexyl(meth)acrylate, perfluorocyclohexylmethyl(meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,4H-hexafluorobutyl(meth) acrylate, 1H,1H,5H-ocatafluoropentyl(meth)acrylate, 1H,1H,7H-dodecafluoroheptyl(meth)acrylate, perfluorooctyl(meth)acrylate, 2-perfluorooctylethyl(meth)acrylate, heptadecafluorodecyl(meth)acrylate, trihydroperfluoroundecyl (meth)acrylate, perfluoronorbonyl(meth)acrylate, 1H-perfluoroisobornyl(meth)acrylate, 2-(N-butylperfluorooctane sulfone amide)ethyl(meth)acrylate, 2-(N-ethylperfluorooctane sulfone amide)ethyl(meth)acrylate, and derivatives introduced from α-fluoroacrylic acid. Bis-hexafluoroisopropyl itaconate, bis-hexafluoro isopropyl malate, bis-perfluorooctyl itaconate, bis-perfluorooctyl malate, bis-trifluoroethyl itaconate, and bis-trifluoroethyl malate. Vinylheptafluorobutylate, vinyl perfluoroheptanoate, vinyl perfluoro nonanoate and vinyl perfluoro octanoate.

The endothermic amount in the differential scanning calorimeter (DSC) for the toner is preferably from 35 mJ/mg to 120 mJ/mg, more preferably from 40 mJ/mg to 100 mJ/mg, and furthermore preferably from 50 mJ/mg to 80 mJ/mg.

The endothermic amount of DSC indicates the amount of the crystalline portion of the toner melted during fixing.

Specifically, the amount of the crystalline polyester unit portion and the releasing agent is indicated.

As the amount of the crystalline portions increases, the sharp melting property of the toner ameliorates, thereby improving the low-temperature fixability.

When the endothermic amount is excessive, it means that the amount of heat required to melt the toner during fixing increases, which may degrade the low-temperature fixability to the contrary.

An excessive endothermic amount is not preferable.

The toner preferably has a ratio {C/(C+A)} of 0.15 or greater, more preferably 0.30 or greater, and particularly preferably 0.45 or greater, where C represents the integration intensity of the spectrum deriving from the crystalline structure of the toner and A represents the integration intensity of the spectrum deriving from the non-crystalline structure of the toner in the diffraction spectrum obtained by an X-ray diffraction device. It is preferable to have a large ratio {C/(C+A)} but the practical upper limit is about 0.50 for the binder resin for use in toner.

When the toner of the present disclosure contains wax, the diffraction peak ascribable to the wax appears at the position of 2θ to 23.5° to 24° in most cases. However, when the content of the wax based on the total weight of the toner is less than, for example, 15% by weight, the contribution of the diffraction peak ascribable to the wax is little and can be left out of consideration.

When the content of the wax is excessively large, a value obtained by subtracting the integral intensity of the spectrum deriving from the crystalline structure of the wax from the integral intensity of the spectrum deriving from the crystalline structure is substituted as the integration intensity C deriving from the crystalline structure.

The ratio {C/(C+A)} is an index that indicates the amount of the crystallized portion in the toner, which is the amount of the crystallized portion of the binder resin contained in the toner as the main component. In the present disclosure, X-ray diffraction measuring is conducted by using an X-ray diffraction device.

A specific example thereof is a two-dimension detector installed X-ray diffraction device (D8 DISCOVER with GADDS, manufactured by BRUKER JAPAN CO., LTD.).

This ratio of known toner that contains a crystalline resin and wax in an amount significantly the same as that of an additive is normally less than about 1.5.

The capillary used for measuring is a mark tube (Lindemann glass) having a diameter of 0.70 mm.

A sample is stuffed to the upper portion of the capillary tube for measuring.

The sample is tapped hundred times during stuffing. The detailed measuring conditions are as follows:

Current: 40 mA
Voltage: 40 kV
Goniometer 2θ axis: 20.0000°
Goniometer Ω axis: 0.0000°
Goniometer ϕ axis: 0.0000°
Detector distance: 15 cm (wide angle measuring)
Measuring range: 3.2≤2θ(°)≤37.2
Measuring time: 600 sec.

A collimator having a 1 mm ϕ pinhole is used as the light incident optical system. The obtained two-dimensional data are integrated (χ axis: 3.2° to 37.2)° and converted by an attached software to a single-dimensional data of the diffraction intensity and 2θ. Based on the obtained X-ray diffraction measuring results, the method of calculating the ratio {C/(C+A)} is described below.

Figure 2:
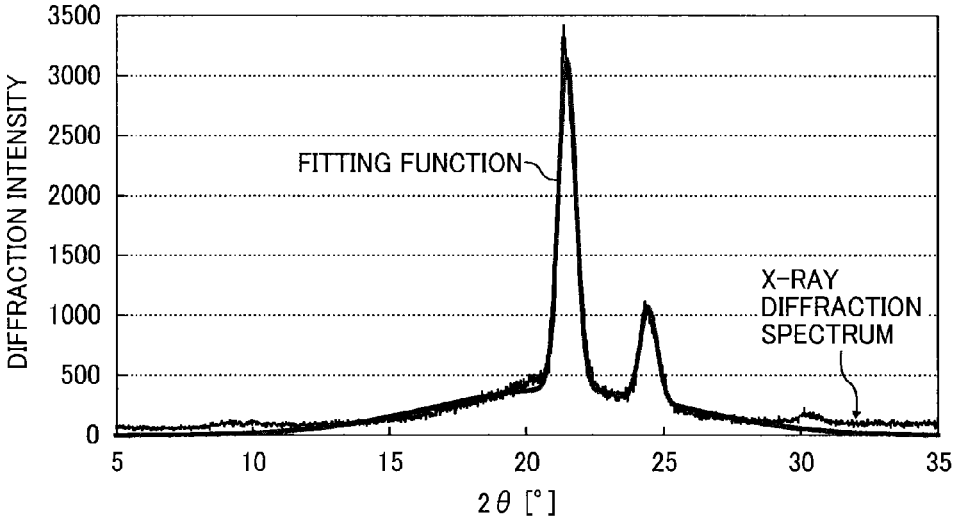
FIG. 2 is a synthesized diffraction spectrum of the diffraction spectrum and the fp1(2θ), fp2(2θ), and fh(2θ) after fitting illustrated in FIG. 1.

FIGS. 1 and 2 are graphs illustrating examples of diffraction spectrum obtained by the X-ray diffraction measuring. X axis is 2θ and Y axis is the X-ray diffraction intensity.

Both are linear axes. As illustrated in FIG. 1, in the X-ray diffraction pattern of the crystalline resin of the present disclosure, the main peaks of P1 and P2 are at 2θ of 21.3° and 24.2°.

Halo (h) is observed in a wide range including these two peaks he main peaks are ascribable to the crystalline portions and, the halo, the non-crystalline portion.

Gaussian function of these two main peaks and halo are as follows:

$$fp1(2\theta)=ap1\exp(-(2\theta-bp1)^2/(2cp1)^2) \quad \text{Relation 1}$$

$$fp2(2\theta)=ap2\exp(-(2\theta-bp2)^2/(2cp2)^2) \quad \text{Relation 2}$$

$$fh(2\theta)=ah\exp(-(2\theta-bh)^2/(2ch)^2) \quad \text{Relation 3}$$

fp1(2θ), fp2(2θ), and fh(2θ) are functions corresponding to the main peaks p1 and p2 and halo, respectively.

The sum of these three functions: f(2θ)=fp1(2θ)+fp2(2θ)+fh(2θ) (Relation 4) is defined as the fitting function of the entire X-ray diffraction spectrum as illustrated in FIG. 2 and fitting is conducted by the least-square approach.

The fitting functions in fitting are nine functions of ap1, bp1, cp1, ap2, bp2, cp2, ah, bh, and ch. As the initial values for fitting of each variable, the peak positions of the X-ray diffraction are assigned for bp1, bp2, and bh (21.3=bp1, 24.2=bp2, 22.5=bh in the example illustrated in FIGS. 1A and 1B) and suitable values are assigned for the other variables to make the two main peaks and the halo significantly match the X-ray diffraction spectrum. Fitting may be conducted by, for example, SOLVER features of EXCEL 2003 manufactured by MICROSOFT CORPORATION.

The ratio {C/(C+A)}, the index indicating the amount of the crystallized portion, can be calculated by the integral areas (Sp1, Sp2, and Sh), where C represents Sp1+Sp2 and A represent Sh calculated by Gaussian integration of Gaussian functions (fp1(2θ), fp2(2θ)) corresponding to the two main peaks P1 and P2 and Gaussian function (fh(2θ)) corresponding to the halo after fitting.

Properties of Toner

The toner of the present disclosure preferably satisfies the following Relations 1 with regard to the maximum endothermic peak temperature T1 (° C.) and the exothermic peak temperature T2 (° C.) as measured by the following method:

$$T1-T2\leq 30^\circ\text{ C. and }T2\geq 30^\circ\text{ C.} \quad \text{Relations 1}$$

Measuring Method and Measuring Condition of Maximum Endothermic Peak and Maximum Exothermic Peak of Toner The maximum endothermic peak of the toner is measurable by DSC SYSTEM Q-200 (manufactured by TA INSTRUMENTS. JAPAN).

Specifically, place about 5.0 g of resin to be measured in an aluminum sample container; place the container on a holder unit to set it in an electric furnace; then, raise the temperature to 100° C. in a nitrogen atmosphere from 0° C. at a temperature rising speed of 10° C./min.; cool down from 100° C. to 0° C. at a temperature descending speed of 10° C./min; raise the temperature from 0° C. to 100° C. at a temperature rising speed of 10° C./min; choose the DSC curve at the second temperature rising using the analysis program in the DSC SYSTEM Q-200 to measure the maximum endothermic peak temperature T1 of the toner.

In addition, measure the maximum exothermic peak temperature T2 of the toner at the temperature descending in the same manner.

T1 is preferably from 50° C. to 70° C., more preferably from 53° C. to 65° C., and furthermore preferably from 58° C. to 62° C.

When T1 is within the range of from 50° C. to 70° C., the high temperature preservation stability of the toner minimally required can be secured and a toner having an excellent low temperature fixability not achieved by typical toner can be obtained.

When T1 is too low, the low temperature fixing property is improved but the high temperature preservation property tends to deteriorate.

When T1 is too high, the high temperature preservation property is improved but the low temperature fixing property tends to deteriorate.

T2 is preferably from 30° C. to 55° C., more preferably from 35° C. to 55° C., and furthermore preferably from 40° C. to 55° C.

When T2 is too low, the fixed image tends to be cooled down and solidified slowly, which may lead to blocking of the toner image or scars during transfer of the image material in the paper path.

It is preferable T2 is as high as possible.

However, T2 is the crystallization temperature and never surpasses T1, which is the melting point.

That is, while maintaining excellent high temperature preservation stability and the low temperature fixability, it is preferable that the temperature difference (T1−T2) is within a narrow range to some extent to reduce the blocking or scars during transfer of the image.

To be specific, the difference (T1−T2) is preferably 30° C. or less, more preferably 25° C. or less, and particularly preferably 20° C. or less. When the difference (T1−T2) is too large, for example, 40° C. or greater, the temperature difference between the fixing temperature and the solidification temperature of the toner image tends to become wide, so that it is not possible to reduce the blocking or scars during transfer of the image.

Toner containing a crystalline resin as its main component has sharp melting property which indicates abrupt decrease of the viscoelasticity at the melting point or higher temperatures and is considered advantageous for the low-temperature fixability.

This is inferred to cause different fixing temperature ranges depending on the kind of paper.

Therefore, typical binder resin for use in toner having excellent low-temperature fixability preferably contains a high molecular weight component.

Specifically, the binder resin contains a component having a molecular weight of 100,000 or more in polystyrene conversion as measured by gel permeation chromatography (GPC) in an at least certain amount and the weight average molecular weight is within a predetermined range to conduct fixing at a constant temperature at a constant speed irrespective of the kind of paper.

The component having a molecular weight of 100,000 or more preferably accounts for 5% by weight or more, more preferably 7% by weight or more, and furthermore preferably 9% by weight or more.

When the component having a molecular weight of 100,000 or more accounts for 5% by weight or more, since dependency of the fluidity and the viscoelasticity of the toner after melting on temperatures decreases, the fluidity and the elasticity of the toner do not significantly change irrespective of the kind of paper, for example, from thin paper easy to convey heat to thick paper difficult to convey heat.

Meaning that the toner is fixed at a constant temperature and a constant speed. When the amount of the component having a molecular weight of 100,000 or more is too small, the fluidity and the elasticity of the toner after the toner is melted significantly change depending on the temperature.

For example, the toner tends to deform excessively if an image is fixed on thin paper, the attachment area of the toner to the fixing member increases.

Consequently, in particular when the temperature of the fixing member is high, paper is not easily released from but wound around the fixing member.

The mechanism of such effect is inferred as follows: Although the crystalline resin has a sharp melting property as described above, the inner agglomeration force and viscoelasticity of the toner in melted state vary depending on the molecular weight of the resin and the structure.

For example, when urethane bond or urea bond, which has a large agglomeration energy, is contained, the toner shows behavior close to an elastic substance such as rubber at relatively low temperatures even when the toner is melted but as the temperature rises, the thermal agitation energy of the polymer chain increases, so that the agglomeration between the bond gradually loosens and the toner tends to get closer to a viscose substance.

If such resin is used as the binder resin for use in toner, no problem with regard to fixing occurs at low fixing temperatures.

However, if the fixing temperature is high, the upper side of the toner image tends to adhere to the fixing member during fixing because the internal agglomeration force in melted toner is small.

This is referred to as hot offset phenomenon, which degrades the image quality significantly.

If the urethane bond or urea bond are increased to avoid hot offset, toner images can be fixed without a problem at high temperatures but the image gloss tends to worsen at low temperature fixing and melting impregnation to paper tends to be insufficient, which causes easy detachment of the image from paper.

In particular, if images are fixed onto thick paper having rough surface, the fixing state tends to deteriorate because the heat conveyance efficiency to the toner is low at fixing or in particular the toner in the elastic state tends to significantly worsen because the pressure is not sufficiently applied to the convex portion of the paper by the fixing member.

If the molecular weight is regulated to control the viscoelasticity of the toner after it is melted, the viscoelasticity tends to increase because the moving of the molecular chain is inhibited naturally as the molecular weight increases.

Furthermore, if the molecular weight is large, entanglement easily occurs, which leads to elastic behavior.

In terms of the fixability on paper, a low molecular weight is preferable because the viscosity is low when the toner is melted.

However, without elasticity in some degree, the hot offset tends to occur.

However, by increasing the molecular weight, the fixability tends to worsen and the fixing state tends to deteriorate in particular for thick paper because the heat conveyance efficiency to toner during fixing is low.

By using toner containing a crystalline polymer while controlling the molecular weight not to be too large as the entire resin, the viscoelasticity after the toner is melted is suitably controlled, so that the toner fixable at a constant temperature and speed irrespective of the kind of paper can be obtained.

The weight average molecular weight is preferably from 20,000 to 70,000, more preferably from 30,000 to 60,000, and particularly preferably from 35,000 to 50,000. When the weight average molecular weight is too large, the fixing property tends to worsen because the entire resin has an excessively high molecular weight.

Therefore, the obtained image has low gloss and/or is easily peeled off by external stress after fixing, which is not preferable.

A weight average molecular weight that is too small tends to result in weak internal agglomeration force during toner melting, which leads to occurrence of hot-offset and winding-round of paper around the fixing member even when the polymer component accounts for a large portion of the resin.

This is not preferable.

Specific examples of the methods of preparing toner containing a binder resin having the molecular weight distribution described above include, but are not limited to, a method of using resins having different molecular weight distributions in combination and a method of using resin whose molecular weight distribution is controlled during polymerization.

In the case of using resins having different molecular weight distributions in combination, it is suitable to use at least two kinds of resins having relatively large molecular weight and small molecular weight.

As the polymer resin having a large molecular weight, it is possible to use resin having a large molecular weight from the beginning or form a polymer by elongating a modified resin having an isocyanate group at its end in the toner manufacturing process.

Polymers are uniformly present in the toner if the polymer is prepared by the latter method.

Also, in the preparation method including the binder resin in an organic solvent, it is easier to dissolve it in the solvent than the resin having a large molecular weight from the beginning.

In the case of the binder resin formed of two kinds of the polymer resin (including modified resin having an isoccyanate group) having a large molecular weight and the resin having a low molecular weight, the resin ratio of the polymer resin to the resin having a low molecular weight is from 5/95 to 60/40, preferably from 8/92 to 50/50, more preferably from 12/88 to 35/65, and furthermore preferably from 15/85 to 25/75.

When the ratio of the polymer resin is too small or large, it is difficult to obtain toner having a binder resin having the molecular weight distribution described above.

When using resin whose molecular weight distribution is regulated during polymerization, a specific examples of preparing such resin is: if the polymerization is such as condensation polymerization, addition polymerization, addition condensation, the molecular weight distribution can be made wider by adding a small amount of a monomer having different number of functional groups to a monomer having two functional groups.

As the monomer having different number of functional groups, there are tri- or higher monomers and monomers having a single functional groups.

If using a tri- or higher monomer is used, the branch structure is generated.

Consequently, if using a crystalline resin, the crystalline structure is not easily formed.

If using a mono-functional monomer, while preparing the resin having a small molecular weight of the two kinds of resins by terminating the polymerization reaction by the mono-functional monomer, the polymerization reaction partially proceeds, thereby forming the polymer resin.

In the present disclosure, the tetrahydrofuran soluble portion of the toner and the molecular weight distribution and the weight average molecular weight (Mw) of the resin can be measured by using a Gel Permeation Chromatography (GPC) measuring device (e.g., HLC-8220GPC, manufactured by TOSOH CORPORATION.) The column is TSK gel Super HZM-M 15 cm triplet (manufactured by TOSOH CORPORATION).

The resin to be measured is dissolved to obtain a 0.15% by weight solution of tetrahydrofuran (THF) (containing a stabilizer, manufactured by WAKO PURE CHEMICAL INDUSTRIES, LTD.) followed by filtration using a filter having an opening of 0.2 μm.

The resultant filtrate is used as a sample. Infuse 100 μl of the THF sample solution into the measuring instrument under the condition that the temperature is 40° C. and the flow speed is 0.35 ml/min.

The molecular weight is calculated by using a standard curve made by a mono-dispersed polystyrene standard sample.

The mono-dispersed polystyrene standard samples are Showdex STANDARD SERIES (manufactured by SHOWA DENKO K.K.) and toluene.

Specific speaking, prepare THF solutions for the following three kinds of mono-dispersed polystyrene standard samples; measure them under the conditions described above; and obtain a standard curve by setting the maintaining time of the peak top as the light scattering molecular weight of the mono-dispersed polystyrene standard samples.

Solution A: S-7450: 2.5 mg; S-678: 2.5 mg, S-46.5: 2.5 mg, S-2.90: 2.5 mm, THF: 50 ml Solution B: S-3730: 2.5 mg, S-257: 2.5 mg, S-19.8: 2.5 mg, S-0.580: 2.5 mm, THF: 50 ml Solution C: S-1470: 2.5 mg, S-112: 2.5 mg, S-6.93: 2.5 mg, Toluene: 2.5 mg, THF: 50 ml.

An refractive index (RI) detector is used as the detector.

The content ratios of the component having a molecular weight of 100,000 or more and the component having a molecular weight of 250,000 or more can be obtained by the intersection of the molecular weight of 100,000 and the molecular weight of 250,000 in the integrated molecular weight distribution curve.

The polymer component is required to have a resin structure close to that of the entire binder resin.

If the binder resin is crystalline, the polymer component is required to be crystalline. When the structure of the polymer component is greatly different from those of the other resin components, the polymer is easily phase-separated to form a sea-island structure, which is not expected to make contribution to improve the viscoelasticity or the agglomeration force to the entire toner.

With regard to comparison of the degree of the content of the crystalline structure in the polymer component and the entire binder resin, for example, the ratio ($\Delta H(H)/\Delta H(T)$) of the endothermic amount ($\Delta H(H)$) of the insoluble portion of the toner in a liquid mixture of ethyl acetate and tetrahydrofuran (THF) having a mixing ratio of 1:1 as measured by DSC to the endothermic amount ($\Delta H(T)$) of the toner preferably ranges from 0.2 to 1.25, more preferably from 0.3 to 1.0, and furthermore preferably from 0.4 to 0.8.

To obtain the insoluble portion in a liquid mixture of ethyl acetate and tetrahydrofuran (THF) having a mixing ratio of 1:1: Add 0.4 g of toner to 40 g of the liquid mixture at 20° C. followed by shaking for 20 minutes; spin down the insoluble portion by a centrifugal; and remove the supernatant solution followed by vacuum drying.

Coloring Agent

There is no specific limit to the coloring agent and any known dyes and pigments can be selected. Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These can be used alone or in combination.

There is no specific limit to the selection of the color of the coloring agent.

For example, coloring agents for black color and coloring agents for color such as magenta, cyan, and yellow can be used.

These can be used alone or in combination.

Specific examples of the black coloring agents include, but are not limited to, carbon black (C.I. Pigment Black 7) such as furnace black, lamp black, acetylene black, and channel black, metals such as copper, iron (C.I. Pigment Black 11), and titanium oxides, and organic pigments such as aniline black (C.I. Pigment Black 1).

Specific examples of the coloring agents for magenta include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I. Vat Red 1, 2, 10, 13, 15, 23, 29, and 35.

Specific examples of the coloring agents for magenta include, but are not limited to, C.I. Pigment Blue 2, 3, 15, 15:1, 15:2, 15:3, 15:4, 15:6, 16, 17, 60; C.I. Vat Blue 6; C.I. Acid Blue 45; Copper phthalocyanine pigments in which one to five phthal imidemethyl groups are substituted in the phthalocyanine skeleton; and Green 7 and Green 36.

Specific examples of the coloring agents for yellow include, but are not limited to, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Vat Yellow 1, 3, and 20; and Orange 36.

There is no specific limit to the content of the coloring agent in the toner.

The content is preferably from 1% by weight to 15% by weight and more preferably from 3% by weight to 10% by weight. When the content of the coloring agent is too small, the coloring performance of the toner tends to deteriorate.

To the contrary, when the content of the coloring agent is too large, dispersion of the pigment in the toner tends to be poor, thereby degrading the coloring performance and the electric characteristics of the toner.

The coloring agent and the resin can be used in combination as a master batch.

There is no specific limit to the resin and any known resin can be suitably selected.

Specific examples thereof include, but are not limited to, styrene or substituted polymers thereof, styrene-based copolymers, polymethyl methacrylate resins, polybutyl methacrylate resins, polyvinyl chloride resins, polyvinyl acetate resins, polyethylene resins, polypropylene resins, polyesters resins, epoxy resins, epoxy polyol resins, polyurethane resins, polyamide resins, polyvinyl butyral resins, polyacrylic resins, rosin, modified rosins, terpene resins, aliphatic hydrocarbon resins, alicyclic hydrocarbon resins, aromatic petroleum resins, chlorinated paraffin, and paraffin.

These can be used alone or in combination.

Specific examples of styrene-based copolymers or substituted polymers of styrene include, but are not limited to, polyester resins, polystyrene resins, poly(p-chlorostyrene) resins, and polyvinyl toluene resins.

Specific examples of the styrene-based copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers.

These master batches can be the crystalline resins for use in the present disclosure.

The master batch is prepared by mixing and kneading the resin for the master batch resin mentioned above and the coloring agent mentioned above upon application of high shear stress thereto. In this case, an organic solvent can be used to boost the interaction between the coloring agent and the resin. In addition, so-called flushing methods are advantageous in that there is no need to drying because a wet cake of the coloring agent can be used as they are.

The flushing method is a method in which a water paste containing water of a coloring agent is mixed or kneaded with an organic solvent and the coloring agent is transferred to the resin side to remove water and the organic solvent component.

High shearing dispersion devices such as a three-roll mill, etc. can be used for mixing or kneading.

The toner can be made as a colorless (clear) toner free from pigments to obtain uniformity of the gloss of an image, designing for a lace image, and other purposes.

Charge Control Agent

The toner of the present disclosure optionally contains a charge control agent.

There is no specific limit to the charge control agent.

Any known charge control agent can be used.

Since the color toner changes when a colored material is used, a material close to clear or white is preferably used for the charge control agent.

Specific examples of the charge control agent include, but are not limited to, triphenylmethane dyes, chelate compounds of molybdic acid, Rhodamine dyes, alkoxyamines, quaternary ammonium salts including fluorine-modified quaternary ammonium salts, alkylamides, phosphor and compounds including phosphor, tungsten and compounds including tungsten, fluorine-containing activators, metal salts of salicylic acid, metal salts of salicylic acid derivatives, etc.

These can be used alone or in combination.

Charge control agents available in the market can be used.

Specific examples thereof include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by ORIENT CHEMICAL INDUSTRIES CO., LTD.; TP-302 and TP-415 (molybdenum complex of quaternary ammonium salt), which are manufactured by HODOGAYA CHEMICAL! CO., LTD.; COPY CHARGE PSY VP2038 (quaternary ammonium salt), COPY BLUE PR (triphenyl methane derivative), COPY CHARGE NEG VP2036 and NX VP434 (quaternary ammonium salt), which are manufactured by HOECHST AG; LRA-901, and LR-147 (boron complex), which are manufactured by JAPAN CARLIT CO., LTD.; quinacridone, azo pigments and polymers having a functional group such as a sulfonate group, a carboxyl group, and a quaternary ammonium group.

The charge control agent can be dissolved and/or dispersed after it is melted, mixed, and kneaded with the master batch.

Alternatively, the charge control agent can be added together with each component of the toner when dissolving and/or dispersing these.

Also, the charge control agent can be fixed on the surface of the toner after manufacturing the toner particles.

The content of the charge control agent in the toner depends on the kind of the binder resin, presence of additives, and dispersion method so that it is not simply regulated but, for example, is preferably from 0.1 parts by weight to 10 parts by weight and more preferably from 0.2 part by weight to 5 parts by weight based on 100 parts by weight of the binder resin. When the content is too low, the charge control property is not easily obtained. When the content is too high, the toner tends to have an excessive chargeability, thereby decreasing the effect of the main charge control agent, increasing the force of electrostatic attraction with the development roller and inviting deterioration of the fluidity of the toner and a decrease in the image density.

External Additive

The toner of the present disclosure optionally contains an external additive.

There is no specific limit to the external additives and any known external additives are suitably usable.

Specific examples thereof include, but are not limited to, silica particulates, hydrophpobized silica particulates, aliphatic acid metal salts (such as zinc stearate and aluminum stearate); metal oxides (such as titania, alumina, tin oxide, antimony oxide), hydrophobized metal oxide particulates, and fluoropolymers.

Among these, hydrorphobized silica particulates, hydrophobized titanium oxide particulates, and hydrophobized alumina particulates are preferable.

Specific examples of the silica particulates include, but are not limited to, HDK H 2000, HDK H 2000/4, HDK H 2050 EP, HVK21, HDK H 1303, (all manufactured by HOECHST AG), R972, R974, RX200, RY200, R202, R805, and R812 (manufactured by NIPPON AEROSIL CO., LTD.) In addition, specific examples of the titan oxide particulates include, but are not limited to, P-25 (manufactured by NIPPON AEROSIL CO., LTD.), STT-30 and STT-65C-S (manufactured by TITAN KOGYO, LTD.), TAF-140 (manufactured by FUJI TITANIUM INDUSTRY CO., LTD.), and MT-150W, MT-500B, MT-600B, and MT-150A (manufactured by TAYCA CORPORATION). Specific examples of the hydrophobized titan oxide particulates include, but are not limited to, T-805 (manufactured by NIPPON AEROSIL CO., LTD.); STT-30A and STT-65S-S (manufactured by TITAN KOGYO, LTD.); TAF-500T and TAF-1500T (manufactured by FUJI TITANIUM INDUSTRY CO., LTD.); MT-100S and MT-100T (manufactured by TAYCA CORPORATION); and IT-S (manufactured by ISHIHARA SANGYO KAISHA LTD.).

The hydrophobized silica particulates, the hydrophobized titan oxide particulates, and the hydrophobized alumina particulates can be obtained by treating hydrophillic particulates such as silica particulates, titanium oxide particualtes, and alumina particualtes with a silane coupling agent such as methyl trimethoxyxilane, methyltriethoxy silane, and octyl trimethoxysilane.

Silicon oil treated inorganic particulates, which are optionally treated with heat, are also preferable as the external additive.

Specific examples of the silicone oils include, but are not limited to, dimethyl silicone oil, methylphenyl silicone oil, chlorophenyl silicone oil, methylhydrogene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether silicone oil, phenol-modified silicone oil, carboxyl-modified silicone oil, mercapto-modified silicone oil, (meth)acryl-modified silicone oil, and α-methylstyrene-modified silicone oil.

Specific examples of such inorganic particulates include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these, silica and titanium dioxide are particularly preferred.

The content of the external additive is preferably from 0.1% by weight to 5% by weight and more preferably from 0.3% by weight to 3% by weight based on the toner.

The inorganic particulate preferably has an average primary particle diameter of from 3 nm to 70 nm. When the average primary particle diameter is too small, the inorganic particulates are embedded in the toner, thereby inhibiting the demonstration of the features thereof. When the average primary particle diameter is too large, the image bearing member is easily damaged non-uniformly.

Inorganic particulates and hydrophobized inorganic particulates can be used in combination as the external additives.

The hydrophobized particulates preferably have a number average primary particle diameter of from 1 nm to 100 nm and more preferably contain at least two kinds of inorganic particulates having a number average primary particle diameter of from 5 nm to 70 nm. Furthermore, the external additives preferably contain at least two kinds of inorganic particulates having a number average primary particle diameter of 20 nm or less and at least one kind of inorganic particulate having a number average primary particle diameter of 30 nm or greater. In addition, it is preferred that the specific surface area of such inorganic particulates measured by the BET method is from 20 $m^2/g$ to 500 $m^2/g$.

Specific examples of surface treating agents of the external additives containing the oxide particulates include, but are not limited to, silane coupling agents such as dialkyl dihalogenated silane, trialkyl halogenized silane, alkyl trihalogenized silane, and hexa alkyl disilazane; silylating agents, silane coupling agents having an alkyl fluoride group, organic titanate coupling agents, aluminum-containing coupling agents, silicone oil, and silicone varnish.

Resin particulates can be added as the external additives.

Specific examples of the resin particulates include, but are not limited to, polystyrene prepared by a soap-free emulsion polymerization method, a suspension polymerization method, or a dispersion polymerization method; and copolymers of methacrylic acid esters and acrylic acid esters; polycondensation resins such as silicone resins, benzoguanamine resins, and nylon resins, and polymerized particles by a thermocuring resin. By a combinational use of such resin particulates, the chargeability of the toner is improved, thereby reducing the reversely charged toner, resulting in a decrease in background fouling.

The content of the resin particulates is preferably from 0.01% by weight to 5% by weight and more preferably from 0.1% by weight to 2% by weight, based on the toner.

Fluidity Improver

The fluidity improver improves the hydrophobic property by surface-treating toner and prevent deterioration of the fluidity and the chargeability of the toner even in a high humidity environment.

Specific examples of the fluidity improver include, but are not limited to, silane coupling agents, silylatng agents, silane coupling agents including an alkyl fluoride group, organic titanate coupling agents, aluminum containing coupling agents, silicone oil, and modified silicone oil.

Cleanability Improver

The toner of the present disclosure optionally uses a cleanability improver.

The cleanability improver is added to toner to remove the development agent remaining on an image bearing member and an intermediate transfer element after transfer.

Specific examples of the cleanability improvers include, but are not limited to, zinc stearate, calcium stearate, and aliphatic metal salts of stearic acid; and polymer particulates such as polymethyl methacrylate particulates and polystyrene particulates, which are manufactured by soap-free emulsion polymerization. The polymer particulates preferably have a relatively narrow particle size distribution and the weight average particle diameter thereof is preferably from 0.01 μm to 1 μm.

Magnetic Material

The toner of the present disclosure can be used as a non-magnetic single-component development agent, a two-component development agent, and magnetic toner containing a magnetic material.

There is no specific limitation to the magnetic materials and any known magnetic materials can be suitably used.

Specific examples thereof include, but are not limited to iron powder, magnetite, and ferrite.

Among these, white magnetic materials are preferable in terms of color tone.

Carrier

There is no specific limit to the carrier.

Carrier is preferable which contains a core material and a resin layer that covers the core material.

Core Material

There is no specific limit to the material for the core material.

The material for the core material can be selected from known materials and specific examples thereof include, but are not limited to, manganese-strontium based material having 50 emu/g to 90 emu/g or manganese-magnesium based material having 50 emu/g to 90 emu/g.

To secure the density of images, high magnetized materials, for example, iron powder not less than 100 emu/g and magnetite from 75 to 120 emu/g, can be preferably used.

Low magnetized materials such as copper-zinc based material having 30 to 80 emu/g are preferable because it can reduce an impact of the development agent in a filament state on the image bearing member and is advantageous for quality images.

These can be used alone or in combination.

There is no specific limit to the volume average particle diameter of the core material.

The volume average particle diameter thereof preferably ranges from 10 μm to 150 μm and more preferably from 40 μm to 100 μm.

When the volume average particle diameter is too small, the ratio of fine particles in carriers tends to increase and the magnetization per particle tends to decrease, which may lead to scattering of carriers.

When the volume average particle diameter is too large, the specific surface area tends to decrease, which may cause scattering of toner.

Thus, the representation of the solid portion may deteriorate particularly in the case of a full color image having a large solid portion area.

When using the toner as the two-component development agent, it is possible to use a mixture of the toner and the carrier.

There is no specific limit to the content of the carrier in the two component development agent.

The content thereof is preferably from 90 parts by weight to 98 parts by weight and more preferably from 93 parts by weight to 97 parts by weight of 100 parts of the two component development agent.

The toner of the present disclosure is suitably used in an image forming apparatus which includes a latent image bearing member, a charging device to charge the surface of the latent image bearing member, an irradiator to irradiate the surface of the charged latent image bearing member to form a latent electrostatic image, a development device to develop the latent electrostatic image with the toner mentioned above to obtain a visual toner image, a transfer device to transfer the visual toner image to a recording medium, and a fixing device to fix the image transferred to the recording medium thereon and an image forming method conducted by the image forming apparatus.

In addition, the toner can be used in a process cartridge which includes at least a latent image bearing member and a development device to develop a latent electrostatic image formed on the latent image bearing member with toner to form a visual image and is detachably attachable to an image forming apparatus.

Having generally described preferred embodiments, further understanding can be obtained by reference to certain specific examples which are provided herein for the purpose of illustration only and are not intended to be limiting.

In the descriptions in the following examples, the numbers represent weight ratios in parts, unless otherwise specified.

EXAMPLES

Next, the present disclosure is described in detail with reference to Examples but not limited thereto.

Measuring of Melting Point, Endothermic Peak Half Value Width, and Glass Transition Temperature (Tg)

The melting point and glass transition temperature of each material is measured by using TG-DSC SYSTEM TAS-100, manufactured by RIGAKU CORPORATION) as follows: Based on the measuring data, calculate the endothermic peak half value width as follows:

That is, place 10 mg of the sample in an aluminum sample container, set the sample container on a holder unit, and set it in an electric furnace. Heat the sample from room temperature to 100° C. at a temperature rising speed of 10° C./min., leave it at 100° C. for 10 minutes, thereafter cool down the sample to room temperature, leave it at room temperature for 10 minutes, and heat the sample again to 100° C. in a nitrogen atmosphere at a temperature rising speed of 10° C./min. by DSC.

Calculate Tg from the intersection of the tangent of the endothermic curve around TG and the base line by using the analysis system installed in TAS-100 SYSTEM. In addition, draw a line segment vertically from the endothermic peak to the base line and determine the temperature difference between the two points where the line passing through the center of the line segment and parallel to the base line crosses the plot of temperature-amount of heat as the half value width of the endothermic peak.

Measuring Content of Straight-chain Mono Ester Having 48 or More Carbon Atoms

Measure the content of the straight-chain mono ester having 48 or more carbon atoms by gas chromatography (GC) as follows: The GC instrument is: 6890N (manufactured by AGILENT TECHNOLOGIES INTERNATIONAL JAPAN LTD.).

The column is: ALLOY-1 (HT) having an internal diameter of 0.5 mm, a length of 10 m.

The detector is:5975 MSD (manufactured by AGILENT TECHNOLOGIES INTERNATIONAL JAPAN LTD.).

Raise the temperature of the column from 40° C. to 200° C. at a temperature rising speed of 40° C./min.; thereafter raise the temperature of the column to 350° C. at a temperature rising speed of 15° C./min.; and thereafter raise the temperature of the column to 450° C. at a temperature rising speed of 7° C./min.

The detection condition is Scan mode with m/z of from 35 to 700.

Use a solution in which 0.1 g of the sample in 10 ml of toluene for DSC.

Identify the structure of the component of the fragment pattern and the retention time of the detected peaks.

Determine the quotient obtained by dividing the area of the all the peaks of the straight-chain mono ester having 48 or more carbon atoms by the area of all the peaks in the total ion chromatogram (TIC) as the content of the straight-chain mono ester having 48 or more carbon atoms.

Manufacturing of Crystalline Resin 1

Place 241 parts of sebacic acid, 31 parts of adipic acid, 164 parts of 1,4-butane diol, and 0.75 parts of titanium dihydroxy bis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 225° C. and distilling away produced water and 1,4-butane diol in a nitrogen atmosphere and continue the reaction with a reduced pressure of from 5 mmHg to 20 mmHg until the weight average molecular weight Mw of the resultant reaches about 18,000 to obtain [Crystalline Resin 1] (crystalline polyester resin) having a melting point of 58° C.

Manufacturing of Crystalline Resin 2

Place 283 parts of sebacic acid, 1 parts of sebacic acid, 215 parts of 1,6-hexane diol, and 1 part of titanium dihydroxy bis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight Mw of the resultant reaches about 17,000 to obtain [Crystalline Resin 2] (crystalline polyester resin) having a melting point of 63° C.

Manufacturing of Crystalline Resin 3

Place 322 parts of dodecanedioic acid, 1 parts of adipic acid, 215 parts of 1,6-hexane diol, and 1 part of titanium dihydroxy bis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 6,000.

Transfer 269 parts of the thus-obtained crystalline resin to a reaction container equipped with a condenser, a stirrer, and a nitrogen introducing tube and add 280 parts of ethyl acetate and 85 parts of tolylene diisocyanate (TDI) thereto to conduct reaction at 80° C. in a nitrogen atmosphere for five hours.

Then, distill away ethyl acetate under a reduced pressure to obtain [Crystalline Resin 3] (crystalline polyurethane resin) having an Mw of about 18,000 with a melting point of 68° C.

Manufacturing of Crystalline Resin 4

Place 283 parts of sebacic acid, 1 parts of sebacic acid, 215 parts of 1,6-hexane diol, and 1 part of titanium dihydroxy bis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water. Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 6,000.

Transfer 249 parts of the thus-obtained crystalline resin to a reaction container equipped with a condenser, a stirrer, and a nitrogen introducing tube and add 250 parts of ethyl acetate and 82 parts of hexamethylene diisocyanate (HDI) thereto to conduct reaction at 80° C. in a nitrogen atmosphere for five hours.

Then, distill away ethyl acetate under a reduced pressue to obtain [Crystalline Resin 4] (crystalline polyurethane resin) having an Mw of about 20,000 with a melting point of 65° C.

Manufacturing of Crystalline Resin 5

Place 283 parts of sebacic acid, 215 parts of 1,6-hexane diol, and 1 part of titanium dihydroxy bis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until Mw reaches about 7,000.

Transfer 200 parts of the thus obtained crystalline resin to a reaction container equipped with a condenser, a stirrer, and a nitrogen introducing tube and add 280 parts of ethyl acetate, 92 parts of 4,4'-diphenyl methane diisocyanate (MDI), and 50 parts of bisphenol A with 2 mols of ethylene oxide thereto to conduct reaction at 80° C. in a nitrogen atmosphere for five hours.

Then, distill away ethyl acetate under a reduced pressue to obtain [Crystalline Resin 5] (crystalline polyurethane resin) having an Mw of about 27,000 with a melting point of 68° C.

Manufacturing of Crystalline Resin 6

Place 283 parts of sebacic acid, 215 parts of 1,6-hexane diol, and 1 part of titanium dihydroxy bis(triethanol aminate) as a condensing catalyst in a reaction container equipped with a condenser, a stirrer, and a nitrogen introducing tube to conduct reaction for eight hours at 180° C. in a nitrogen atmosphere while distilling away produced water.

Next, conduct reaction for four hours while gradually heating the system to 220° C. and distilling away produced water and 1,6-hexane diol in a nitrogen atmosphere and continue the reaction with a reduced pressure of from 5 mmHg to 20 mmHg until the weight average molecular weight Mw of the resultant reaches about 39,000 to obtain [Crystalline Resin 6] (crystalline polyester resin) having a melting point of 65° C.

Manufacturing of Non-Crystalline Resin 1

Place 219 parts of an adduct of bisphenol A with 2 mols of ethylene oxide, 130 parts of an adduct of bisphenol A with 2 mols of propylene oxide, 26 parts of terephthalic acid, and 140 parts of isophthalic acid, and 0.5 parts of tetrabutoxy titanate in a reaction container equipped with a condenser, a stirrer, and a nitrogen introducing tube to conduct reaction at 230° C. for eight hours in a nitrogen atmosphere while distilling away produced water. Next, conduct reaction at a reduced pressure of from 5 mmHg to 20 mmHG, cool down to 180° C. when the acid value is 2, add 35 parts to trimellitic anhydride, and conduct reaction at normal pressure for three hours to obtain [Non-Crystalline Resin 1].

The obtained [Non-Crystalline Resin 1] has an Mw of 9,100 and a Tg of 62° C.

Manufacturing of Prepolymer A of Non-Crystalline Resin

Place 247 parts of hexamethylene diisocyanate (HDI) and 247 parts of ethyl acetate in a reaction container equipped with a condenser, a stirrer, and a nitrogen introducing tube and add a resin solution in which 249 parts of [Crystalline Resin 4] is dissolved in 249 parts of ethyl acetate thereto to conduct reaction at 80° C. for five hours in a nitrogen atmosphere to obtain 50% by weight ethyl acetate solution of [Prepolymer A of Crystalline Resin] having an isocyanate group at its end.

Manufacturing of Prepolymer B of Non-Crystalline Resin

The following components are placed in a container equipped with a condenser, a stirrer and a nitrogen introducing tube to conduct a reaction at 230° C. at normal pressure for 8 hours followed by another reaction for 5 hours with a reduced pressure of from 10 mmHg to 15 mmHg to synthesize [Intermediate Polyester]:

| | |
|---|---|
| Adduct of bisphenol A with 2 mole of ethylene oxide: | 682 parts |
| Adduct of bisphenol A with 2 mole of propylene oxide: | 81 parts |
| Terephthalic acid: | 283 parts |
| Trimellitic anhydride: | 22 parts |
| Dibutyl tin oxide: | 2 parts |

The obtained [Intermediate Polyester] has a number average molecular weight of 2,100, a weight average molecular weight Mw of 9,500, a glass transition temperature Tg of 55° C., an acid value of 0.5 mgKOH/g, and a hydroxyl value of 49 mgKOH/g.

Next, place 411 parts of [Intermediate Polyester], 89 parts of isophorone diisocyanate, and 500 parts of ethyl acetate in a reaction container equipped with a condenser, stirrer and a nitrogen introducing tube to conduct reaction at 100° C. for 5 hours to obtain

[Prepolymer B of Non-Crystalline Resin].

The obtained [Prepolymer B of Non-Crystalline Resin] has an isolated isocyanate amount of 1.53% by weight.

Manufacturing of Synthesized Ester Wax 1

Place 362 parts of stearyl alcohol and 638 parts of melissic acid in a reaction container equipped with a condenser, stirrer and a nitrogen introducing tube to conduct reaction at 200° C. for 20 hours in a nitrogen atmosphere while distilling away produced water, cool down the system to 80° C., add a liquid mixture of toluene and ethanol, and add potassium hydroxide aqueous solution followed by 30 minute stirring.

Then, remove the aqueous phase followed by washing with deionized water three times and dry the resultant at 190° C. under a reduced pressure to obtain [Synthesized Ester Wax 1].

[Synthesized Ester Wax 1] has a content of the straight-chain mono ester having 48 or more carbon atoms of 99% by weight, a melting point of 79° C., and a half value width of the endothermic peak of 4.3° C.

Manufacturing of Synthesized Ester Wax 2

Place 408 parts of behenyl alcohol and 595 parts of melissic acid in a reaction container equipped with a condenser, stirrer and a nitrogen introducing tube to conduct reaction at 220° C. for 18 hours in a nitrogen atmosphere while distilling away produced water, cool down the system to 80° C., add a liquid mixture of toluene and ethanol, and add potassium hydroxide aqueous solution followed by 30 minute stirring. Then, remove the aqueous phase followed by washing with deionized water three times and dry the resultant at 190° C. under a reduced pressure to obtain [Synthesized Ester Wax 2].

[Synthesized Ester Wax 2]has a content of the straight-chain mono ester having 48 or more carbon atoms of 100% by weight, a melting point of 83° C., and a half value width of the endothermic peak of 4.5° C.

Manufacturing of Synthesized Ester Wax 3

Place 474 parts of behenyl alcohol and 525 parts of behenic acid in a reaction container equipped with a condenser, stirrer and a nitrogen introducing tube to conduct reaction at 220° C. for 18 hours in a nitrogen atmosphere while distilling away produced water, cool down the system to 80° C., add a liquid mixture of toluene and ethanol, and add potassium hydroxide aqueous solution followed by a 30 minute stirring. Then, remove the aqueous phase followed by washing with deionized water three times and dry the resultant at 190° C. under a reduced pressure to obtain [Synthesized Ester Wax 3].

[Synthesized Ester Wax 3] has a content of the straight-chain mono ester having 48 or more carbon atoms of 0% by weight, a melting point of 70° C., and a half value width of the endothermic peak of 4.1° C.

Manufacturing of Synthesized Ester Wax 4

Place 438 parts of behenyl alcohol, 225 parts of behenic acid, and 337 parts of melissic acid in a reaction container equipped with a condenser, stirrer and a nitrogen introducing tube to conduct reaction at 220° C. for 18 hours in a nitrogen atmosphere while distilling away produced water, cool down the system to 80° C., add a liquid mixture of toluene and ethanol, and add potassium hydroxide aqueous solution followed by 30 minute stirring. Then, remove the aqueous phase followed by washing with deionized water three times and dry the resultant at 190° C. under a reduced pressure to obtain [Synthesized Ester Wax 4].

[Synthesized Ester Wax 4] has a content of the straight-chain mono ester having 48 or more carbon atoms of 60% by weight, a melting point of 75° C., and a half value width of the endothermic peak of 6.2° C.

Manufacturing of Synthesized Ester Wax 5

Place 447 parts of behenyl alcohol, 320 parts of behenic acid, and 232 parts of melissic acid in a reaction container equipped with a condenser, stirrer and a nitrogen introducing tube to conduct reaction at 220° C. for 18 hours in a nitrogen atmosphere while distilling away produced water, cool down the system to 80° C., add a liquid mixture of toluene and ethanol, and add potassium hydroxide aqueous solution followed by 30 minute stirring. Then, remove the aqueous phase followed by washing with deionized water three times and dry the resultant at 190° C. under a reduced pressure to obtain [Synthesized Ester Wax 5].

[Synthesized Ester Wax 5] has a content of the straight-chain mono ester having 48 or more carbon atoms of 42% by weight, a melting point of 74° C., and a half value width of the endothermic peak of 8.6° C.

Manufacturing of Synthesized Ester Wax 6

Place 454 parts of behenyl alcohol, 354 parts of behenic acid, and 197 parts of melissic acid in a reaction container equipped with a condenser, stirrer and a nitrogen introducing tube to conduct reaction at 220° C. for 18 hours in a nitrogen atmosphere while distilling away produced water, cool down the system to 80° C., add a liquid mixture of toluene and ethanol, and add potassium hydroxide aqueous solution followed by 30 minute stirring.

Then, remove the aqueous phase followed by washing with deionized water three times and dry the resultant at 190° C. under a reduced pressure to obtain [Synthesized Ester Wax 6].

[Synthesized Ester Wax 6] has a content of the straight-chain mono ester having 48 or more carbon atoms of 35% by weight, a melting point of 72° C., and a half value width of the endothermic peak of 7.7° C.

Manufacturing of Synthesized Ester Wax 7

Place 61 parts of ethylene glycol and 951 parts of melissic acid in a reaction container equipped with a condenser, stirrer and a nitrogen introducing tube to conduct reaction at 180° C. for 24 hours in a nitrogen atmosphere while distilling away produced water, cool down the system to 80° C., add a liquid mixture of toluene and ethanol, and add potassium hydroxide aqueous solution followed by 30 minute stirring. Then, remove the aqueous phase followed by washing with deionized water three times and dry the resultant at 190° C. under a reduced pressure to obtain [Synthesized Ester Wax 7].

[Synthesized Ester Wax 7] has a content of the straight-chain mono ester having 48 or more carbon atoms of 0% by weight, a melting point of 72° C., and a half value width of the endothermic peak of 4.8° C.

Manufacturing of Synthesized Ester Wax 8

Place 342 parts of behenyl alcohol, 85 parts of stearyl alcohol, 254 parts of behenic acid, and 310 parts of melissic acid in a reaction container equipped with a condenser, stirrer and a nitrogen introducing tube to conduct reaction at 200° C. for 20 hours in a nitrogen atmosphere while distilling away produced water, cool down the system to 80° C., add a liquid mixture of toluene and ethanol, add potassium hydroxide aqueous solution followed by 30 minute stirring to remove the aqueous phase, wash the resultant with deionized water three times followed by drying at 190° C. with a reduced pressure to obtain [Synthesized Ester Wax 8].

[Synthesized Ester Wax 8] has a content of the straight-chain mono ester having 48 or more carbon atoms of 44% by weight, a melting point of 68° C., and a half value width of the endothermic peak of 11.1° C.

Manufacturing of Synthesized Ester Wax 9

Place 342 parts of behenyl alcohol, 85 parts of stearyl alcohol, 254 parts of behenic acid, and 310 parts of melissic acid in a reaction container equipped with a condenser, stirrer and a nitrogen introducing tube to conduct reaction at 200° C. for 17 hours in a nitrogen atmosphere while distilling away produced water, cool down the system to 80° C., add a liquid mixture of toluene and ethanol, add potassium hydroxide aqueous solution followed by 20 minute stirring to remove the aqueous phase, wash the resultant with deionized water three times followed by drying at 190° C. with a reduced pressure to obtain [Synthesized Ester Wax 9].

[Synthesized Ester Wax 9] has a content of the straight-chain mono ester having 48 or more carbon atoms of 41% by weight, a melting point of 64° C., and a half value width of the endothermic peak of 14.4° C.

Method of Preparing Liquid Dispersion of Coloring Agent

Place 20 parts of copper phthalocyanine, 4 parts of a coloring agent dispersant (SOLSPERS 28000, available from AVECIA), 76 parts of ethyl acetate in a beaker, stir them for uniform dispersion, and finely-disperse copper phthalocyanine by a bead mill to obtain [Liquid Dispersion 1 of Coloring Agent].

[Liquid Dispersion 1 of Coloring Agent] has a volume average particle diameter of 0.3 μm as measured by a particle diameter measuring instrument (LA-920, manufactured by HORIBA. LTD.)

Method of Preparing Liquid Dispersion 1 of Releasing Agent

Place 15 parts of {Synthesized Ester Wax 1] and 85 parts of ethyl acetate in a reaction container equipped with a condenser, a stirrer and sufficiently dissolve them to 78° C.

After cooling down the system to 30° C. in one hour while stirring, wet-pulverize the resultant in an ULTRA VISCO MILL, manufactured by AIMEX Co., Ltd.) under the condition of a liquid feeding speed of 1.0 Kg/h, a disk peripheral speed of 10 m/s, 0.5 mm zirconia bead filling amount of 80%, and a number of passes of 6. Adjust the concentration of the solid portion concentration to be 15% by addition of ethyl acetate to obtain [Liquid Dispersion 1 of Releasing Agent].

Method of Preparing Liquid Dispersions 2 to 7 of Releasing Agent

[Liquid Dispersions 2 to 7 of Releasing Agent] are obtained in the same manner as in the case of [Liquid Dispersion 1 of Releasing Agent] except that [Synthesized Ester Wax 1] is changed to [Synthesized Ester Wax 2 to 7].

Method of Preparing Liquid Dispersion 8 of Releasing Agent [Liquid Dispersion 8 of Releasing Agent] is obtained in the same manner as in the case of [Liquid Dispersion 1 of Releasing Agent] except that [Synthesized Ester Wax 1] is changed to sunflower wax (content of the straight-chain mono ester having 48 or more carbon atoms: 53% by weight, melting point: 78° C., and a half value width of the endothermic peak of 6.6° C.

Method of Preparing Liquid Dispersion 9 of Releasing Agent

[Liquid Dispersion 9 of Releasing Agent] is obtained in the same manner as in the case of [Liquid Dispersion 1 of Releasing Agent] except that [Synthesized Ester Wax 1] is changed to paraffin wax (content of the straight-chain mono ester having 48 or more carbon atoms: 0% by weight, melting point: 76° C., and a half value width of the endothermic peak of 3.9° C.

Method of Preparing Liquid Dispersion 10 of Releasing Agent

[Liquid Dispersions 10 of Releasing Agent] is obtained in the same manner as in the case of [Liquid Dispersion 1 of Releasing Agent] except that [Synthesized Ester Wax 1] is changed to [Synthesized Ester Wax 8].

Method of Preparing Liquid Dispersion 11 of Releasing Agent

[Liquid Dispersions 11 of Releasing Agent] is obtained in the same manner as in the case of [Liquid Dispersion 1 of Releasing Agent] except that [Synthesized Ester Wax 1] is changed to [Synthesized Ester Wax 9].

Method of Preparing Resin Solutions 1 to 6

Place 100 parts of [Crystalline Resins 1 to 6] and 100 parts of ethyl acetate in a reaction container equipped with a thermometer and a stirrer and heat the system to 50° C. while stirring to obtain a uniform phase [Resin Solutions 1 to 6].

Manufacturing of Carrier A

Prepare a liquid application by dispersing 450 parts of toluene, 472 parts of silicone resin (SR2400, non-volatile component: 50%, manufactured by DOW CORNING TORAY CO., LTD.), 11 parts of aminosilane (SH6020, manufactured by DOW CORNING TORAY CO., LTD.), and 12 parts of carbon black as coating material with a stirrer for 15 minutes. Place 5,000 parts of Mn ferrite particles (weight average particle diameter: 35 μm) as core material and the liquid application in a coating device that conducts coating while forming a swirl flow by a rotatable base plate disk and a stirring wing in the flowing floor to apply the liquid application to the core material. Bake the thus-obtained coated material in an electric furnace at 250° C. for three hours to obtain [Carrier A].

Example 1

Place 45 parts of [Resin Solution 3], 15 parts of [Resin Solution 6], 14 parts of [Liquid Dispersion 1 of Releasing Agent], and 10 parts of [Liquid Dispersion 1 of Coloring Agent] in a beaker, dissolve and disperse them by stirring by TK type HOMOMIXER at 50° C. at 8,000 rotations per minute (rpm) to obtain [Liquid Toner Material 1].

Place 99 parts of deionized water, 6 parts of 25% by weight aqueous liquid dispersion of organic resin particulates (a copolymer of styrene—methacrylic acid—butyl acrylate—a sodium salt of sulfate of an adduct of methacrylic acid with ethyleneoxide) for stabilizing dispersion, 1 part of carboxy methyl cellulose sodium, and 10 parts of 48.5% aqueous solution of sodium dodecyldiphenyl etherdisulfonate (ER-EMINOR MON-7, manufactured by SANYO CHEMICAL INDUSTRIES, LTD.), in a beaker and dissolve them uniformly.

Stir them at 50° C. by a TK type HOMOMIXER at 10,000 rpm, add 75 parts of [Liquid Toner Material] to the beaker, and stir them for two minutes.

Thereafter, transfer this liquid mixture to a flask equipped with a stirrer and a thermometer and distill away ethyl acetate until the concentration reaches 0.5% by weight at 55° C. to obtain [Aqueous Resin Dispersion Element 1 of Resin Particle].

Thereafter, as the pre-washing process, cool down and filtrate [Aqueous Resin Dispersion Element 1 of Resin Particle] to room temperature, add 300 parts of deionized water to the thus-obtained filtered cake and mix them by a TK type HOMOMIXER at 12,000 rpm for 10 minutes followed by filtration twice.

Thereafter, add 300 parts of deionized water to the thus-obtained filtered cake and mix them by a TK type HOMOMIXER at 12,000 rpm for 10 minutes followed by filtration three times.

Add 300 parts of 1% by weight hydrochloric acid to the thus-obtained filtered cake and mix them by a TK type HOMOMIXER at 12,000 rpm for 10 minutes followed by filtration.

Add 300 parts of deionized water to the thus-obtained filtered cake and mix the resultant by a TK type HOMOMIXER at a rotation number of 12,000 rpm for 10 minutes followed by filtration twice to obtain a final filtered cake.

Subsequent to pulverization of the filtered cake, dry it at 40° C. for 22 hours to obtain [Resin Particle 1] having a volume average particle diameter of 5.6 μm.

Mix 100 parts of the thus-obtained [Resin Particle 1] and 1.0 part of hydrophobic silica (H-2000, manufactured by CLARIANT JAPAN K.K.) serving as an external additive by using a HENSCEL MIXER (manufactured by NIPPON COKE & ENGINEERING CO., LTD.) at a peripheral speed of 30 m/s for 30 seconds followed by one-minute break.

Repeat this cycle five times and screen the resultant with a mesh having an opening of 35 μm to manufacture [Toner 1].

The content of the releasing agent in [Toner 1] is 4% by weight.

Example 2

[Toner 2] is manufactured in the same manner as in Example 1 except that [Liquid Dispersion 1 of Releasing Agent] is changed to [Liquid Dispersion 2 of Releasing Agent] to obtain [Resin Particle 2].

Example 3

[Toner 3] is manufactured in the same manner as in Example 1 except that [Liquid Dispersion 1 of Releasing Agent] is changed to [Liquid Dispersion 4 of Releasing Agent] to obtain [Resin Particle 3].

Example 4

[Toner 4] is manufactured in the same manner as in Example 1 except that [Liquid Dispersion 1 of Releasing Agent] is changed to [Liquid Dispersion 5 of Releasing Agent] to obtain [Resin Particle 4].

Example 5

[Toner 5] is manufactured in the same manner as in Example 1 except that [Liquid Dispersion 1 of Releasing Agent] is changed to [Liquid Dispersion 8 of Releasing Agent] to obtain [Resin Particle 5].

Example 6

[Toner 6] is manufactured in the same manner as in Example 5 except that the number of parts of [Liquid Dispersion 8 of Releasing Agent] is changed from 14 parts to 49 parts to obtain [Resin Particle 6]. The content of the releasing agent in [Toner 6] is 14% by weight.

Example 7

[Toner 7] is manufactured in the same manner as in Example 5 except that the number of parts of [Liquid Dispersion 8 of Releasing Agent] is changed from 14 parts to 7 parts to obtain [Resin Particle 7]. The content of the releasing agent in [Toner 7] is 2% by weight.

Example 8

[Toner 8] is manufactured in the same manner as in Example 1 except that [Resin Solution 3] is changed to [Resin Solution 1] to obtain [Resin Particle 8].

Example 9

[Toner 9] is manufactured in the same manner as in Example 4 except that [Resin Solution 6] is changed to [Prepolymer A of Crystalline Resin] to obtain [Resin Particle 9

Example 10

[Toner 10] is manufactured in the same manner as in Example 9 except that [Resin Solution 3] is changed to [Resin Solution 5] to obtain [Resin Particle 10].

Example 11

Agglomeration Method Toner

Preparation of Crystalline Resin Latex 1

Add 40 g of [Crystalline Resin 1] to 360 g of deionized water followed by heating to 90° C., adjust pH to be 7.5 by an aqueous solution of 4% by weight sodium hydroxide solution, and add 0.8 g of 10% by weight dodecyl benzen sulfonic acid aqueous solution while stirring by an ULTRA-TURRAX T50 by IKA at 8,000 rpm to manufacture [Crystalline Resin Latex 1] having a center particle diameter of 320 nm.

The concentration of the solid portion of the latex is 11% by weight.

Preparation of Crystalline Resin Latex 2

Add 1.1 g of 10% by weight dodecyl benzene sulfonic acid aqueous solution to 360 g of deionized water, adjust pH to be 9.0 by an aqueous solution of 4% by weight sodium hydroxide solution to prepare an aqueous phase followed by heating to 55° C.

Heat 80 g of [Polymer A of Crystalline Resin] to 55° C. to fluidize and place the fluidized resultant to the aqueous phase, stir them by an ULTRA-TURRAX T50 by IKA at 8,000 rpm for 10 minutes, and remove ethyl acetate until the concentration of ethyl acetate is 0.5% by weight to obtain [Crystalline Resin Latex 2] having a center particle diameter of 350 nm.

The concentration of the solid portion of the latex is 10% by weight.

Preparation of Liquid Dispersion B-1 of Cyan Pigment

Mix and dissolve the following recipe and disperse the resultant by a HOMOGENIZER (ULTRA-TURRAX, available from IKA) and irradiation with ultrasonic to obtain [Liquid Dispersion B-1 of Cyan Pigment] having a center particle diameter of h nm.

| | |
|---|---|
| Cyan pigment: C.I. Pigment Blue 15:3: | 50 g (copper phthalocyanine, manufactured by DIC Corporation) |
| Anionic surface active agent (NEOGEN SC, manufactured by Dai--Ichi Kogyo Seiyaku Co., Ltd.) | 5 g |
| Deionized water | 200 g |

Preparation of Liquid Dispersion C-1 of Releasing Agent

Mix the following recipe followed by heating to 97° C. and disperse them by ULTRA-TURRAX ULTRA-TURRAX, available from IKA.

Thereafter, conduct dispersion by using GAULIN HOMOGENIZE (available from MEIWAFOSIS CO., LTD.) 20 times at 105° C. with a condition of 550 kg/cm$^2$ to obtain [Liquid Dispersion C-1 of Releasing Agent] having a center diameter of 190 nm.

| | |
|---|---|
| [Synthesized Ester Wax 1] | 100 g |
| Anionic surface active agent (NEOGEN SC, manufactured by Dai--Ichi Kogyo Seiyaku Co., Ltd.) | 5 g |
| Deionized water | 300 g |

Preparation of Resin Paricle 11

| | |
|---|---|
| Crystalline Resin Latex 1 | 260 parts |
| Crystalline Resin Latex 2 | 120 parts |

-continued

| | |
|---|---|
| Liquid Dispersion B-1 of Cyan Pigment | 10 parts |
| Liquid Dispersion C-1 of Releasing Agent | 8 parts |
| Polyauminum chloride | 0.15 parts |
| Deionized water | 400 parts |

Subsequent to sufficient mixing and dispersion of the recipe specified above in a stainless flask by a HOMOGENIZER (ULTRA-TURRAX T50, available from IKA), heat the system to 48° C. while stirring the flask in an oil bath for heating to agglomerate particles.

After confirming that the particle diameter reaches 5.7 μm, adjust pH of the system by 0.5 mol/l sodium hydroxide aqueous solution to be 6.0, and heat the system to 70° C. while continuing stirring. pH of the system decreases to about 5.6 while heating to 70° C. but keep it as it is.

Cool it down when the circularity is 0.972.

Subsequent to filtration, add 300 parts of deionized water to the thus-obtained filtered cake and mix the resultant by a TK type HOMOMIXER at 12,000 rpm for 10 minutes followed by filtration twice to obtain a filtered cake.

Thereafter, add 300 parts of deionized water to the thus-obtained filtered cake and mix them by a TK type HOMOMIXER at 12,000 rpm for 10 minutes followed by filtration three times.

Add 300 parts of 1% by weight hydrochloric acid to the thus-obtained filtered cake and mix them by a TK type HOMOMIXER at 12,000 rpm for 10 minutes followed by filtration.

Add 300 parts of deionized water to the thu-obtained filtered cake and mix the resultant by a TK type HOMOMIXER at a rotation number of 12,000 rpm for 10 minutes followed by filtration twice to obtain a final filtered cake.

Subsequent to pulverization of the filtered cake, dry it at 40° C. for 22 hours to obtain [Resin Particle 11] having a volume average particle diameter of 5.6 μm Manufacturing of Toner 11

Mix 100 parts of the thus-obtained [Resin Particle 11] and 1.0 part of hydrophobic silica (H-2000, manufactured by CLARIANT JAPAN K.K.) serving as an external additive by using a HENSCEL MIXER (manufactured by NIPPON COKE & ENGINEERING CO., LTD.) at a peripheral speed of 30 m/s for 30 seconds followed by one-minute break.

Repeat this cycle five times and screen the resultant with a mesh having an opening of 35 μm to manufacture [Toner 11].

Example 12

[Toner 12] is manufactured in the same manner as in Example 1 except for using no [Liquid Dispersion 1 of Coloring Agent].

Example 13

[Toner 13] is manufactured in the same manner as in Example 5 except that the number of parts of [Liquid Dispersion 8 of Releasing Agent] is changed from 14 parts to 77 parts to obtain [Resin Particle 13].

The content of the releasing agent in [Toner 13] is 22% by weight.

Example 14

[Toner 14] is manufactured in the same manner as in Example 1 except that [Liquid Dispersion 1 of Releasing Agent] is changed to [Liquid Dispersion 10 of Releasing Agent] to obtain [Resin Particle 14]. [Toner 14] clumps after left at 50° C. for one day while [Toner 13] dose not.

Example 15

[Toner 15] is manufactured in the same manner as in Example 1 except that [Liquid Dispersion 1 of Releasing Agent] is changed to [Liquid Dispersion 11 of Releasing Agent] to obtain [Resin Particle 15]. [Toner 15] clumps after left at 50° C. for one day.

Example 16

Place 25 parts of [Resin Solution 3], 10 parts of [Non-Crystalline Resin 1], 10 parts of ethyl acetate, 10 parts of [Resin Solution 6], 5 parts of [Prepolymer B of Non-Crystalline Resin], 14 parts of [Liquid Dispersion 1 of Releasing Agent], and 10 parts of [Liquid Dispersion 1 of Coloring Agent] in a beaker, dissolve and disperse them by stirring by a TK type HOMOMIXER at 50° C. at 8,000 rpm to obtain [Liquid Toner Material 16].

[Toner 16] is manufactured in the same manner as in Example 1 except that [Resin Solution 6] is changed to [Liquid Toner Material 16] to obtain [Resin Particle 16].

Example 17

[Toner 17] is manufactured in the same manner as in Example 1 except that 0.06 parts of a nucleating agent (ADK STAB NA-11 having a melting point of 400° C., manufactured by ADEKA CORPORATION) is added to the liquid toner material to obtain [Resin Particle 17].

Example 18

[Toner 18] is manufactured in the same manner as in Example 1 except that [Resin Solution 6] is changed to [Prepolymer B of Non-Crystalline Resin] to obtain [Resin Particle 18].

Comparative Example 1

[Toner 101] is manufactured in the same manner as in Example 1 except that [Liquid Dispersion 1 of Releasing Agent] is changed to [Liquid Dispersion 3 of Releasing Agent] to obtain [Resin Particle 101].

Comparative Example 2

[Toner 102] is manufactured in the same manner as in Example 1 except that [Liquid Dispersion 1 of Releasing Agent] is changed to [Liquid Dispersion 9 of Releasing Agent] to obtain [Resin Particle 102].

Comparative Example 3

[Toner 103] is manufactured in the same manner as in Example 1 except that [Liquid Dispersion 1 of Releasing Agent] is changed to [Liquid Dispersion 6 of Releasing Agent] to obtain [Resin Particle 103].

Comparative Example 4

[Toner 104] is manufactured in the same manner as in Example 1 except that [Liquid Dispersion 1 of Releasing Agent] is changed to [Liquid Dispersion 7 of Releasing Agent] to obtain [Resin Particle 104].

With regard to each toner of Examples and Comparative Examples, measure {C/(C+A)}, T1−T2, T2, the ratio of resin having a molecular weight of 100,000 or more, the weight average molecular weight, and (ΔH(H)/ΔH(T)) according to the methods described above. Evaluate the fixing releasability, the low-temperature fixability, and the contamination at discharging port of fixing.

The results are shown in Table 1.

Fixing Releasability

Figure 3:
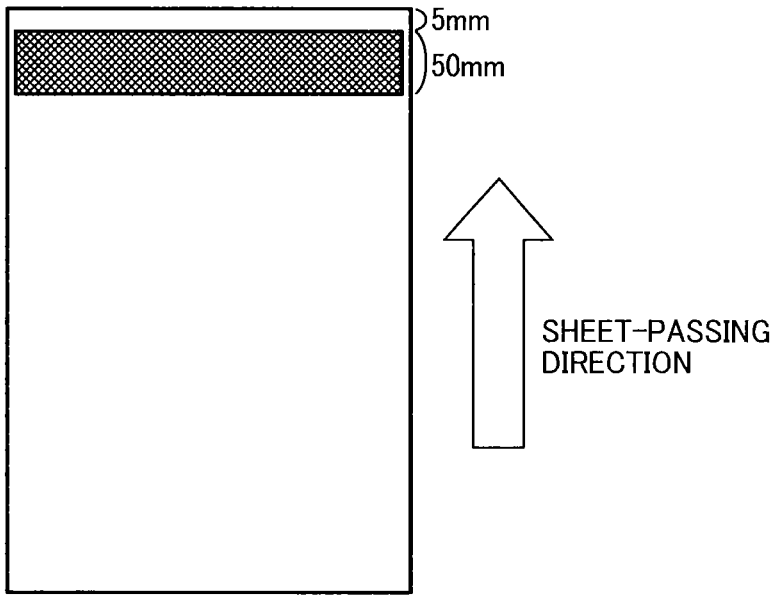
FIG. 3 is a diagram illustrating the solid image for use to evaluate the fixing releasability.

Output a solid image having a 50 mm width with an amount of toner attachment of from 0.75 mg/cm2 to 0.95 mg/cm$^2$ at a position of thin photocopying paper (<55>, manufactured by RICOH CO., LTD.) (machine direction: longitudinal) 5 mm from its front end as illustrated in FIG. 3 with a run length of 10.

Use an electrophotographic photocopier whose fixing device is remodeled based on MF-200, manufactured by RICOH CO., LTD., using a TEFLON(R) roller as the fixing roller to evaluate the releasing of paper having an image thereon when the image passes under the condition in which the temperature of the fixing belt is externally controlled to be 160° C. or 220° C. according to the following evaluation criteria.

E (Excellent): All of 10 fixable with no problem

G (Good): No paper jamming even though several of them nearly caught up by fixing roller F (Fair): Paper jam occurs to 1 or 2

B (Bad): paper jam occurs to 3 to 6

VB (Very Bad): paper jam occurs to 7 or more

Check whether there is damage in the paper traveling direction during transfer in the paper path by observing the image surface output with no problem at 160° C.

E (Excellent): No damage at all

G (Good): Damage very slightly observed depending on the observation angle

F (Fair): Damage slightly observed irrespective of the observation angle

B (Bad): Damage clearly observed irrespective of the observation angle

Low-Temperature Fixability

Using the same device as for the evaluation on the fixing releasability, form a solid image with an amount of toner attachment of from 0.75 mg/cm$^2$ to 0.95 mg/cm2 on plain paper or thick paper (TYPE 6200, manufactured by RICOH CO., LTD.) while raising the temperature of the fixing belt from 85° C. with a gap of 5° C. by external control.

With regard to the fixing image, determine the lowest temperature at which the solid image is fixed intact to naked eyes and no scratch is observed on the colored portion of the surface of the fixed image by naked eyes after the tip of a sapphire needle (radius: 125 μm) with a needle rotation diameter of 8 mm and a load of 1 g runs on the colored portion as the lowest fixing temperature.

Contamination at Discharging Port of Fixing

Uniformly mix 14 parts of the toner manufactured as described above with 200 parts of [Carrier A] by using a turbuler mixer (manufactured by Willy A. Bachofen (WAB) AG) which tumbles the container for stirring at 48 rpm for three minutes to manufacture a two-component development agent.

Set the manufactured two-component development agent in the development unit of an electrophotographic multi-functional printer (MP C4001A SP, manufactured by RICOH CO., LTD.).

Also fill a toner bottle with the toner for use in the two component development agent and set it to the development unit.

Continue printing a solid image on the entire of the paper with a run length of 1,000 and observe the sate of the image on the 1,000th sheet to evaluate it according to the following criteria:

E (Excellent): No damage observed on fixed image or no attachment observed at discharging port of fixing G (Good): No damage observed on fixed image but attachment slightly observed at discharging port of fixing F (Fair): Damage slightly observed on fixed image and attachment observed at discharging port of fixing B (Bad): Damage clearly observed on fixed image and attachment observed at discharging port of fixing

TABLE 1

| | Releasing agent | | | |
|---|---|---|---|---|
| | Content ratio (% by weight) of Straight-chain mono ester having 48 or more carbon atoms | Melting point (° C.) | Content ratio (% by weight) | Half value width (° C.) |
| Example 1 | 99 | 79 | 4 | 4.3 |
| Example 2 | 100 | 83 | 4 | 4.5 |
| Example 3 | 60 | 75 | 4 | 6.2 |
| Example 4 | 42 | 74 | 4 | 8.6 |
| Example 5 | 56 | 78 | 4 | 6.6 |
| Example 6 | 56 | 78 | 14 | 6.6 |
| Example 7 | 56 | 78 | 2 | 6.6 |
| Example 8 | 99 | 73 | 4 | 4.3 |
| Example 9 | 42 | 74 | 4 | 8.6 |
| Example 10 | 42 | 74 | 4 | 8.6 |
| Example 11 | 99 | 79 | 4 | 4.3 |
| Example 12 | 99 | 79 | 4 | 4.3 |
| Example 13 | 53 | 78 | 22 | 6.6 |
| Example 14 | 44 | 68 | 4 | 11.1 |
| Example 15 | 41 | 64 | 4 | 14.4 |
| Example 16 | 99 | 79 | 4 | 4.3 |
| Example 17 | 99 | 79 | 4 | 4.3 |
| Example 18 | 99 | 79 | 4 | 4.3 |
| Comparative Example 1 | 0 | 70 | 4 | 4.1 |
| Comparative Example 2 | 0 | 76 | 4 | 3.9 |
| Comparative Example 3 | 35 | 72 | 4 | 7.7 |
| Comparative Example 4 | 0 | 72 | 4 | 4.8 |

| | Toner | | | | | | |
|---|---|---|---|---|---|---|---|
| | Endothermic amount (mJ/mg) | C/(C + A) | T1 − T2 (° C.) | T2 (° C.) | Ratio of molecular weight having 100,000 or more (% by weight) | Weight average molecular weight | ΔH(H)/ΔH(T) |
| Example 1 | 63 | 0.32 | 32 | 63 | 1.8 | 23,200 | 0.75 |
| Example 2 | 62 | 0.33 | 32 | 62 | 2.1 | 23,500 | 0.72 |
| Example 3 | 61 | 0.33 | 32 | 64 | 2.2 | 22,800 | 0.90 |
| Example 4 | 60 | 0.32 | 34 | 64 | 1.9 | 22,900 | 0.81 |
| Example 5 | 62 | 0.31 | 31 | 62 | 1.9 | 23,900 | 0.71 |
| Example 6 | 66 | 0.30 | 32 | 65 | 2.1 | 23,700 | 0.79 |
| Example 7 | 60 | 0.32 | 32 | 64 | 2.0 | 21,900 | 0.88 |
| Example 8 | 81 | 0.35 | 31 | 60 | 1.4 | 22,200 | 0.84 |
| Example 9 | 60 | 0.29 | 33 | 63 | 7.8 | 35,100 | 1.01 |
| Example 10 | 44 | 0.23 | 37 | 61 | 9.3 | 36,900 | 1.12 |
| Example 11 | 62 | 0.31 | 32 | 64 | 2.2 | 24,000 | 0.68 |
| Example 12 | 63 | 0.31 | 32 | 64 | 1.9 | 23,100 | 0.75 |
| Example 13 | 65 | 0.32 | 31 | 62 | 1.9 | 22,800 | 0.95 |
| Example 14 | 63 | 0.32 | 32 | 63 | 2.0 | 23,500 | 0.75 |
| Example 15 | 63 | 0.31 | 32 | 62 | 2.0 | 23,400 | 0.88 |
| Example 16 | 38 | 0.16 | 31 | 33 | 2.0 | 26,100 | 0.77 |
| Example 17 | 79 | 0.35 | 18 | 64 | 1.8 | 22,900 | 0.74 |
| Example 18 | 40 | 0.21 | 32 | 63 | 7.7 | 33,300 | 0.22 |
| Comparative Example 1 | 62 | 0.32 | 32 | 62 | 1.9 | 23,300 | 0.75 |
| Comparative Example 2 | 63 | 0.31 | 33 | 64 | 2.2 | 24,400 | 0.72 |

TABLE 1-continued

| | | | | | | | |
|---|---|---|---|---|---|---|---|
| Comparative Example 3 | 63 | 0.34 | 31 | 62 | 2.2 | 22,800 | 0.79 |
| Comparative Example 4 | 61 | 0.31 | 31 | 63 | 2.0 | 22,200 | 0.84 |

| | Evaluation Results | | | | |
|---|---|---|---|---|---|
| | Fixing releasability (160° C.) | Fixing releasability (220° C.) | Damage during transfer | low-temperature fixability (° C.) | Contamination at discharging port of fixing |
| Example 1 | E | B | F | 95 | E |
| Example 2 | E | F | F | 100 | E |
| Example 3 | G | F | F | 90 | G |
| Example 4 | F | B | F | 90 | F |
| Example 5 | G | B | F | 95 | E |
| Example 6 | E | F | G | 95 | G |
| Example 7 | F | F | F | 95 | E |
| Example 8 | E | B | F | 100 | E |
| Example 9 | E | G | F | 95 | F |
| Example 10 | E | E | F | 90 | F |
| Example 11 | G | F | F | 95 | E |
| Example 12 | E | B | F | 95 | E |
| Example 13 | E | G | G | 95 | F |
| Example 14 | F | F | F | 90 | F |
| Example 15 | B | F | F | 90 | F |
| Example 16 | E | F | F | 105 | E |
| Example 17 | E | B | E | 95 | E |
| Example 18 | B | B | F | 115 | E |
| Comparative Example 1 | VB | VB | B | 90 | B |
| Comparative Example 2 | E | F | F | 95 | B |
| Comparative Example 3 | VB | VB | F | 90 | F |
| Comparative Example 4 | VB | VB | B | 95 | E |

What is claimed is:

1. Toner comprising:

a binder resin comprising at least one resin comprising a crystalline polyester unit as a main component; and a releasing agent comprising a straight-chain mono ester having 48 or more carbon atoms accounting for 40% by weight or more of the releasing agent, wherein a ratio of $\Delta H(H)/\Delta H(T)$ ranges from 0.2 to 1.25, where $\Delta H(T)$ represents an endothermic amount of the toner as measured by a differential scanning calorimeter and $\Delta H(H)$ represents an endothermic amount of an insoluble portion of the toner in a liquid mixture of ethyl acetate and tetrahydrofuran (THF) having a mixing ratio of 1:1 as measured by a differential scanning calorimeter.

2. The toner according to claim 1, wherein the releasing agent has a melting point of from 65° C. to 80° C.

3. The toner according to claim 1, wherein the releasing agent has an endothermic peak half value width of 10° C. or less.

4. The toner according to claim 1, wherein the releasing agent accounts for 3% by weight to 20% by weight of the toner.

5. The toner according to claim 1, wherein, in a diffraction spectrum obtained by an X-ray diffraction device, $\{C/(C+A)\}$ is 0.15 or greater, wherein C represents an integration intensity of a spectrum deriving from a crystalline structure of the toner and A represents an integration intensity of a spectrum deriving from a non-crystalline structure of the toner.

6. The toner according to claim 1, wherein the toner satisfies the following relations:

$$T1-T2 \leq 30° \text{ C. and } T2 \geq 30° \text{ C.},$$

where T1 represents a maximum endothermic peak temperature for a second time temperature rising and T2 represents a maximum exothermic peak temperature for a first time temperature descending as measured by a differential scanning calorimeter in a temperature range of from 0° C. to 100° C. at a temperature rising and descending speed of 10° C./min.

7. The toner according to claim 1, wherein a tetrahydrofuran-soluble component in the toner has a weight average molecular weight of from 20,000 to 70,000, with a molecular weight of 100,000 or greater accounting for 5% or more by weight of the tetrahydrofuran-soluble component as measured by gel permeation chromatography.

8. The toner according to claim 1, wherein the crystalline polyester unit comprises a urethane bond or a urea bond.

9. The toner according to claim 1, wherein the binder resin comprising a crystalline polyester unit is a block polymer of a polyester and a polyurethane.

10. The toner according to claim 1, wherein at least one resin comprising a crystalline polyester unit comprises two or more resins having different molecular weights.

11. The toner according to claim 1, manufactured by granulation in an aqueous medium.

12. The toner according to claim 11, wherein the at least one resin is a modified crystalline resin having an isocyanate group at an end thereof and prepared by elongation reaction and/or cross-linking reaction with an active hydrogen group while granulating toner particles by dispersion and/or emulsification in an aqueous medium.

13. A development agent comprising:

the toner of claim 1; and toner carrier.

* * * * *